US010990029B2

(12) United States Patent
Akizuki et al.

(10) Patent No.: US 10,990,029 B2
(45) Date of Patent: Apr. 27, 2021

(54) IMAGE FORMING APPARATUS CORRECTING EXPOSURE AMOUNT OF PHOTOSENSITIVE MEMBER

(71) Applicant: CANON KABUSHIKI KAISHA, Tokyo (JP)

(72) Inventors: Tomoo Akizuki, Kawasaki (JP); Kenichi Iida, Tokyo (JP); Hikaru Osada, Kamakura (JP); Yusuke Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/847,849

(22) Filed: Apr. 14, 2020

(65) Prior Publication Data

US 2020/0241439 A1 Jul. 30, 2020

Related U.S. Application Data

(63) Continuation of application No. 16/245,558, filed on Jan. 11, 2019, now Pat. No. 10,656,549.

(30) Foreign Application Priority Data

Jan. 18, 2018 (JP) ..... 2018-006690

(51) Int. Cl.
*G03G 15/041* (2006.01)
*G03G 15/09* (2006.01)
(Continued)

(52) U.S. Cl.
CPC ..... *G03G 15/0415* (2013.01); *G03G 15/0928* (2013.01); *G03G 15/04027* (2013.01); *G03G 15/5041* (2013.01)

(58) Field of Classification Search
CPC ..... G03G 15/011; G03G 15/043; G03G 15/0415; G03G 15/0848; G03G 15/0928;
(Continued)

(56) References Cited

U.S. PATENT DOCUMENTS 5,274,426 A 12/1993 Goseki et al.
5,574,544 A * 11/1996 Yoshino ..... H04N 1/4078 358/519
(Continued)

FOREIGN PATENT DOCUMENTS

JP 3029162 B2 4/2000
JP 2005-219386 A 8/2005
(Continued)

*Primary Examiner* — Hoan H Tran
(74) *Attorney, Agent, or Firm* — Venable LLP

(57) ABSTRACT

An image forming apparatus includes a photosensitive member; a scan unit configured to scan the photosensitive member with light based on image data, and form a latent image on the photosensitive member; a developing unit configured to form an image on the photosensitive member by attaching toner to the latent image formed on the photosensitive member; and a correction unit configured to correct an exposure amount of the photosensitive member such that a density change of the image in a main scanning direction due to a configuration of the scan unit and a density of the image to be formed is reduced.

32 Claims, 24 Drawing Sheets

(51) Int. Cl.
*G03G 15/04* (2006.01)
*G03G 15/00* (2006.01)

(58) Field of Classification Search
CPC ..... G03G 15/0121; G03G 15/5025; G03G 15/5041; G03G 2215/29; G03G 2215/0634
USPC ..... 399/118, 177–179, 196, 198, 200, 208, 399/209
See application file for complete search history.

(56) References Cited

U.S. PATENT DOCUMENTS

| | | | | |
|---|---|---|---|---|
| 7,382,387 | B2 | 6/2008 | Ichikawa et al. | |
| 7,817,932 | B2 | 10/2010 | Hamanaka | |
| 8,626,041 | B2 * | 1/2014 | Tominaga | G03G 15/5008 399/301 |
| 9,030,513 | B2 | 5/2015 | Toyoizumi et al. | |
| 9,188,902 | B2 | 11/2015 | Yamazaki | |
| 9,606,472 | B2 | 3/2017 | Fujii et al. | |
| 10,025,221 | B2 * | 7/2018 | Lida | G03G 15/04027 |
| 10,496,004 | B2 * | 12/2019 | Seki | G03G 15/043 |
| 2016/0216632 | A1 * | 7/2016 | Ishidate | G02B 26/123 |

FOREIGN PATENT DOCUMENTS

| | | | |
|---|---|---|---|
| JP | 2015-178213 | A | 10/2015 |
| JP | 2016-150579 | A | 8/2016 |
| JP | 2018-195916 | * | 12/2018 |

* cited by examiner

FIG. 7
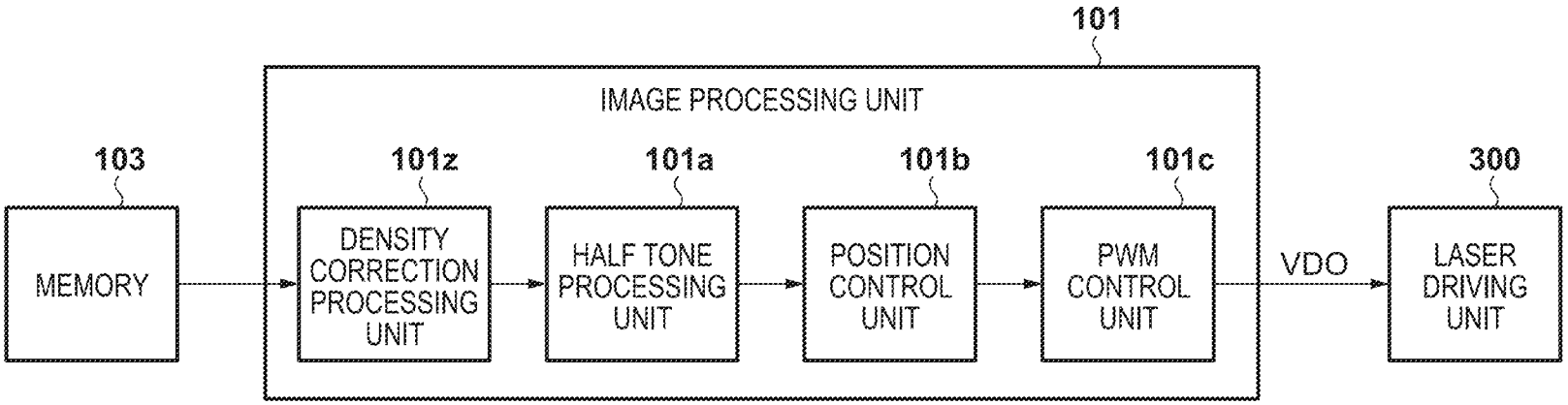
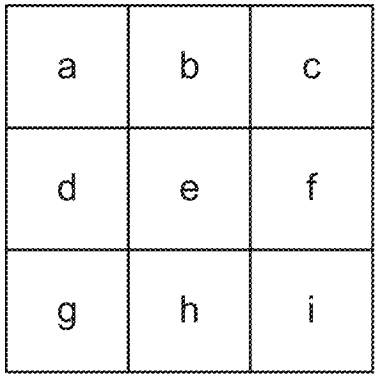
FIG. 8

FIG. 9

| a | | b | | c | | d | | e | | f | | g | | h | | i | |
|---|---|---|---|---|---|---|---|---|---|---|---|---|---|---|---|---|---|
| LEVEL | THRE-SHOLD VALUE | LEVEL | THRE-SHOLD VALUE | LEVEL | THRE-SHOLD VALUE | LEVEL | THRE-SHOLD VALUE | LEVEL | THRE-SHOLD VALUE | LEVEL | THRE-SHOLD VALUE | LEVEL | THRE-SHOLD VALUE | LEVEL | THRE-SHOLD VALUE | LEVEL | THRE-SHOLD VALUE |
| 1 | 144 | 1 | 30 | 1 | 153 | 1 | 87 | 1 | 1 | 1 | 96 | 1 | 153 | 1 | 58 | 1 | 144 |
| 2 | 147 | 2 | 31 | 2 | 155 | 2 | 90 | 2 | 2 | 2 | 99 | 2 | 155 | 2 | 59 | 2 | 147 |
| 3 | 150 | 3 | 32 | 3 | 157 | 3 | 93 | 3 | 3 | 3 | 102 | 3 | 157 | 3 | 60 | 3 | 150 |
| 4 | 153 | 4 | 33 | 4 | 159 | 4 | 96 | 4 | 4 | 4 | 105 | 4 | 159 | 4 | 62 | 4 | 153 |
| 5 | 156 | 5 | 35 | 5 | 161 | 5 | 99 | 5 | 6 | 5 | 108 | 5 | 161 | 5 | 64 | 5 | 156 |
| 6 | 159 | 6 | 37 | 6 | 163 | 6 | 102 | 6 | 8 | 6 | 111 | 6 | 163 | 6 | 66 | 6 | 159 |
| 7 | 162 | 7 | 39 | 7 | 165 | 7 | 105 | 7 | 10 | 7 | 114 | 7 | 165 | 7 | 68 | 7 | 162 |
| 8 | 165 | 8 | 41 | 8 | 167 | 8 | 108 | 8 | 12 | 8 | 117 | 8 | 167 | 8 | 70 | 8 | 165 |
| 9 | 168 | 9 | 43 | 9 | 169 | 9 | 111 | 9 | 14 | 9 | 120 | 9 | 169 | 9 | 72 | 9 | 168 |
| 10 | 171 | 10 | 45 | 10 | 171 | 10 | 114 | 10 | 16 | 10 | 123 | 10 | 171 | 10 | 74 | 10 | 171 |
| 11 | 172 | 11 | 47 | 11 | 229 | 11 | 117 | 11 | 18 | 11 | 126 | 11 | 238 | 11 | 76 | 11 | 201 |
| 12 | 173 | 12 | 49 | 12 | 230 | 12 | 120 | 12 | 20 | 12 | 129 | 12 | 239 | 12 | 78 | 12 | 202 |
| 13 | 174 | 13 | 51 | 13 | 231 | 13 | 123 | 13 | 22 | 13 | 132 | 13 | 240 | 13 | 80 | 13 | 203 |
| 14 | 175 | 14 | 53 | 14 | 233 | 14 | 126 | 14 | 24 | 14 | 135 | 14 | 241 | 14 | 82 | 14 | 204 |
| 15 | 177 | 15 | 55 | 15 | 235 | 15 | 129 | 15 | 26 | 15 | 138 | 15 | 243 | 15 | 84 | 15 | 206 |
| 16 | 179 | 16 | 57 | 16 | 236 | 16 | 132 | 16 | 28 | 16 | 141 | 16 | 245 | 16 | 85 | 16 | 208 |
| 17 | 181 | 17 | 57 | 17 | 237 | 17 | 133 | 17 | 29 | 17 | 143 | 17 | 246 | 17 | 86 | 17 | 209 |
| 18 | 181 | 18 | 153 | 18 | 237 | 18 | 163 | 18 | 144 | 18 | 163 | 18 | 246 | 18 | 163 | 18 | 209 |
| 19 | 181 | 19 | 154 | 19 | 237 | 19 | 164 | 19 | 145 | 19 | 164 | 19 | 246 | 19 | 164 | 19 | 209 |
| 20 | 181 | 20 | 155 | 20 | 237 | 20 | 165 | 20 | 146 | 20 | 165 | 20 | 246 | 20 | 165 | 20 | 209 |
| 21 | 181 | 21 | 156 | 21 | 237 | 21 | 166 | 21 | 147 | 21 | 166 | 21 | 246 | 21 | 166 | 21 | 209 |
| 22 | 181 | 22 | 157 | 22 | 237 | 22 | 167 | 22 | 148 | 22 | 167 | 22 | 246 | 22 | 167 | 22 | 209 |
| 23 | 181 | 23 | 159 | 23 | 237 | 23 | 169 | 23 | 150 | 23 | 169 | 23 | 246 | 23 | 168 | 23 | 209 |
| 24 | 181 | 24 | 162 | 24 | 237 | 24 | 171 | 24 | 152 | 24 | 171 | 24 | 246 | 24 | 171 | 24 | 209 |
| 25 | 181 | 25 | 247 | 25 | 237 | 25 | 210 | 25 | 182 | 25 | 191 | 25 | 246 | 25 | 219 | 25 | 209 |
| 26 | 181 | 26 | 248 | 26 | 237 | 26 | 211 | 26 | 183 | 26 | 192 | 26 | 246 | 26 | 220 | 26 | 209 |
| 27 | 181 | 27 | 249 | 27 | 237 | 27 | 212 | 27 | 184 | 27 | 193 | 27 | 246 | 27 | 221 | 27 | 209 |
| 28 | 181 | 28 | 250 | 28 | 237 | 28 | 214 | 28 | 185 | 28 | 194 | 28 | 246 | 28 | 223 | 28 | 209 |
| 29 | 181 | 29 | 251 | 29 | 237 | 29 | 216 | 29 | 186 | 29 | 196 | 29 | 246 | 29 | 225 | 29 | 209 |
| 30 | 181 | 30 | 253 | 30 | 237 | 30 | 217 | 30 | 188 | 30 | 198 | 30 | 246 | 30 | 227 | 30 | 209 |
| 31 | 181 | 31 | 255 | 31 | 237 | 31 | 218 | 31 | 190 | 31 | 200 | 31 | 246 | 31 | 228 | 31 | 209 |

FIG. 10

| | | |
|---|---|---|
| R | C | L |
| R | C | L |
| R | C | L |

FIG. 11

| LEVEL | PWM VALUE | C | L | R |
|---|---|---|---|---|
| 0 | 0 | | | |
| 1 | 15 | | | |
| 2 | 30 | | | |
| 3 | 45 | | | |
| 4 | 60 | | | |
| 5 | 75 | | | |
| 6 | 90 | | | |
| 7 | 105 | | | |
| 8 | 120 | | | |
| 9 | 135 | | | |
| 10 | 150 | | | |
| 11 | 165 | | | |
| 12 | 180 | | | |
| 13 | 195 | | | |
| 14 | 210 | | | |
| 15 | 225 | | | |

| LEVEL | PWM VALUE | C | L | R |
|---|---|---|---|---|
| 16 | 240 | | | |
| 17 | 255 | | | |
| 18 | 240 | | | |
| 19 | 225 | | | |
| 20 | 210 | | | |
| 21 | 195 | | | |
| 22 | 180 | | | |
| 23 | 165 | | | |
| 24 | 150 | | | |
| 25 | 165 | | | |
| 26 | 180 | | | |
| 27 | 195 | | | |
| 28 | 210 | | | |
| 29 | 225 | | | |
| 30 | 240 | | | |
| 31 | 255 | | | |

FIRST EMBODIMENT

COMPARATIVE EXAMPLE 1

THIRD EMBODIMENT

COMPARATIVE EXAMPLE 2

FOURTH EMBODIMENT

COMPARATIVE EXAMPLE 3

111
BD SIGNAL
CLOCK FREQUENCY RATIO (%)
100 100 100

IMAGE FORMING APPARATUS CORRECTING EXPOSURE AMOUNT OF PHOTOSENSITIVE MEMBER

BACKGROUND OF THE INVENTION

Field of the Invention

The present invention relates to electrophotographic image forming apparatuses such as a laser beam printer, a digital copier, and a digital FAX (facsimile machine).

Description of the Related Art

In an image forming apparatus, the image density in the main scanning direction is not uniform due to several reasons. For example, a developing apparatus that performs development by attaching toner to an electrostatic latent image, in the image forming apparatus, causes toner particles to be charged by friction between a developing sleeve and toner particles. In order to make the image density uniform in a main scanning direction, toner particles need to be uniformly charged in a longitudinal direction (main scanning direction) of the developing sleeve without the toner particles being excessively charged. Here, on an end portion side of the developing sleeve in the main scanning direction, the flowability of toner particles decreases due to the resistance of a side wall, and the flow speed of the toner particles decreases relative to those on a central side of the developing sleeve. Therefore, toner particles on the end portion side are in contact with the developing sleeve for a period longer than those on the central portion side, and are likely to be more charged than those on the central portion side. As a result, the density at the end portion in the main scanning direction decreases relative to that in the central portion.

U.S. Pat. No. 5,274,426 discloses a configuration in which toner particles can be uniformly charged by changing the content ratio of conductive fine particles between a central portion and an end portion of a coating layer of the developing sleeve, or by differentiating the polishing processing of the coating layer.

However, the configuration in U.S. Pat. No. 5,274,426 complicates the structure and configuration of the developing sleeve, and the cost of the image forming apparatus increases.

As shown in the example described above, in an image forming apparatus, the image density in the main scanning direction is not uniform due to several factors. That is, the density may change along the main scanning direction.

SUMMARY OF THE INVENTION

According to an aspect of the present invention, an image forming apparatus includes: a photosensitive member; a scan unit configured to scan the photosensitive member with light based on image data, and form a latent image on the photosensitive member; a developing unit configured to form an image on the photosensitive member by attaching toner to the latent image formed on the photosensitive member; and a correction unit configured to correct an exposure amount of the photosensitive member such that a density change of the image in a main scanning direction due to a configuration of the scan unit and a density of the image to be formed is reduced.

Further features of the present invention will become apparent from the following description of exemplary embodiments with reference to the attached drawings.

BRIEF DESCRIPTION OF THE DRAWINGS

FIG. 7 is a functional block diagram of an image processing unit according to one embodiment.

FIG. 8 is a diagram illustrating a dither matrix according to one embodiment.

FIG. 9 is a diagram illustrating a threshold value table according to one embodiment.

FIG. 10 is a diagram illustrating a position control matrix according to one embodiment.

FIG. 11 is a diagram illustrating a relationship between a level and a pulse signal according to one embodiment.

DESCRIPTION OF THE EMBODIMENTS

Hereinafter, illustrative embodiments of the present invention will be described with reference to the drawings. Note that the following embodiments are illustrative and do not limit the present invention to the contents of the embodiments. Also, in the following diagrams, constituent elements that are not required for describing the embodiments are omitted.

First Embodiment

Figure 1:
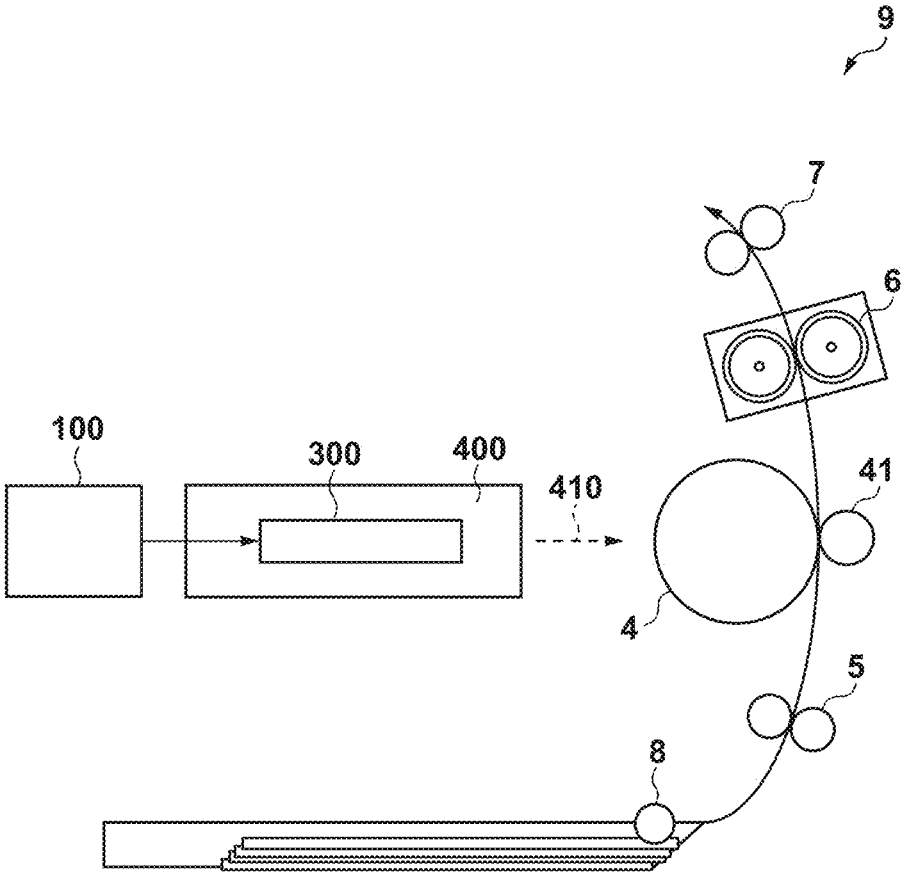
FIG. 1 is a configuration diagram of an image forming apparatus according to one embodiment.

FIG. 1 is a schematic configuration diagram of an image forming apparatus 9 according to the present embodiment. A laser driving unit 300 of an optical scanning apparatus 400 emits a light beam 410 based on an image signal output from an image signal generation unit 100. A photosensitive member 4 that is charged by an unshown charging unit is scanned and exposed by this light beam 410, and a latent image is formed on the surface of the photosensitive member 4. An unshown developing unit forms a toner image by developing the latent image with toner. Also, a recording medium fed by a feeding unit 8 is conveyed to a nip region of the photosensitive member 4 and a transfer roller 41 by a conveyance roller 5. The transfer roller 41 transfers the toner image formed on the photosensitive member 4 to the recording medium. Thereafter, the recording medium is conveyed to a fixing unit 6. The fixing unit 6 applies heat and pressure to the recording medium to fix the toner image to the recording medium. The recording medium on which the toner image has been fixed is discharged to the outside of the image forming apparatus 9 by a sheet discharge roller 7.

Figure 2A:
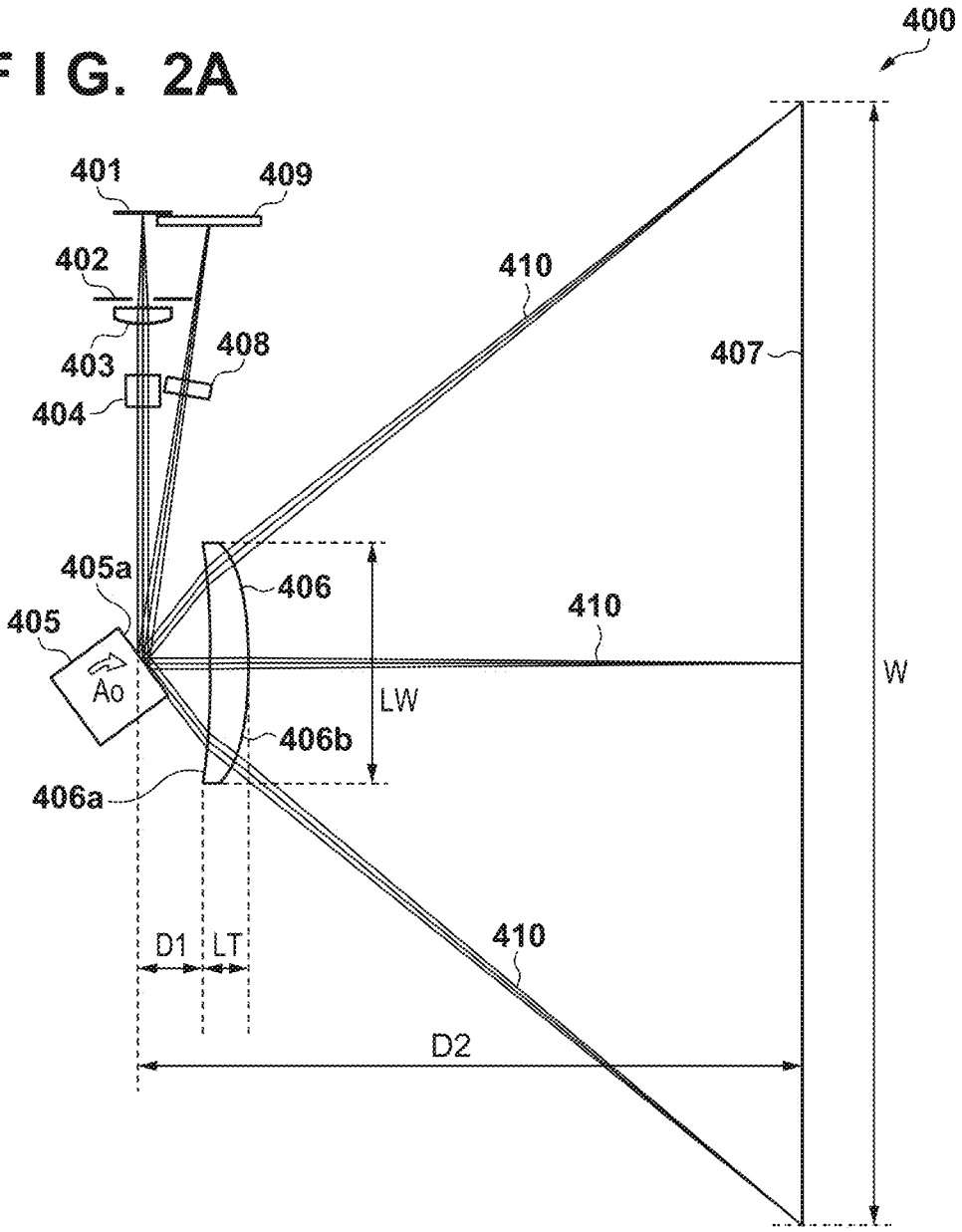
FIGS. 2A and 2B are configuration diagrams of an optical scanning apparatus according to one embodiment.
Figure 2B:
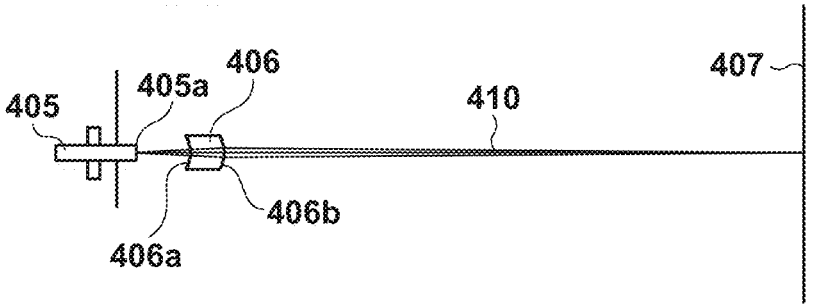

FIGS. 2A and 2B are configuration diagrams of the optical scanning apparatus 400 according to the present embodiment, with FIG. 2A showing a cross-section in the main scanning direction, and FIG. 2B showing a cross-section in the sub-scanning direction. The light beam (light flux) 410 emitted from a light source 401 is formed into an elliptical shape by an aperture diaphragm 402 and is incident on a coupling lens 403. The light beam 410 that has passed through the coupling lens 403 is transformed to nearly parallel light and is incident on an anamorphic lens 404. Note that nearly parallel light includes weak convergence light and weak divergence light. The anamorphic lens 404 has a positive refractive power within a cross-section in the main scanning direction, and transforms an incident light flux into convergence light within a cross-section in the main scanning direction. Also, the anamorphic lens 404, within a cross-section of the sub-scanning direction, collects light flux near a deflection surface 405*a* of a deflector 405, and forms a long line image in the main scanning direction.

The light flux that has passed through the anamorphic lens 404 is reflected by a reflective surface 405*a* of the deflector (polygon mirror) 405. The light beam 410 reflected by the reflective surface 405*a* passes through an imaging lens 406, and forms a predetermined spot-like image (hereinafter, referred to as a "spot") on the surface of the photosensitive member 4. As a result, the photosensitive member 4 is irradiated with light and exposed. By rotating the deflector 405 at a constant angular velocity in the direction of arrow Ao using a drive unit that is not illustrated, the spot moves in the main scanning direction on a scan surface 407 of the photosensitive member 4, and forms a latent image on the scan surface 407. Note that the main scanning direction is a direction parallel to the rotation axis of the photosensitive member 4. Also, the sub-scanning direction is the circumferential direction of the photosensitive member 4.

A beam detector (hereinafter referred to as "BD") sensor 409 and a BD lens 408 constitute a synchronization optical system that determines the timing for writing the electrostatic latent image onto the scan surface 407. The light beam 410 that has passed through the BD lens 408 is incident on the BD sensor 409, which includes a photodiode, and is detected. The write timing with respect to the photosensitive member 4 (timing of forming a latent image) is controlled based on the timing at which the light beam 410 is detected by the BD sensor 409. The light source 401 of the present embodiment includes one light emitting unit, but the light source 401 may include a plurality of light emitting units that can be independently controlled to emit light.

As shown in FIGS. 2A and 2B, the imaging lens 406 has two optical surfaces (lens surfaces) consisting of an incident surface 406*a* and an emission surface 406*b*. The imaging lens 406 is configured to scan the scan surface 407 with the light flux deflected by the reflection surface 405*a* with a desired scan characteristic, in a cross-section in the main scanning direction. Also, the imaging lens 406 is configured to form the spot of the light beam 410 into a desired shape on the scan surface 407.

In the present embodiment, the imaging lens 406 does not have so-called fθ characteristics. That is, the spot does not move at a uniform speed on the scan surface 407 when the deflector 405 is rotated at a uniform angular velocity. As a result of using the imaging lens 406 that does not have fθ characteristics, it is possible to dispose the imaging lens 406 close to the deflector 405 (at a position at which a distance D1 is small). Also, with the imaging lens 406 that does not have fθ characteristics, a length (width LW) in the main scanning direction and a length (thickness LT) in the optical axis direction can be reduced relative to the case of an imaging lens having fθ characteristics. Accordingly, the size of the optical scanning apparatus 400 can be reduced. Also, there are cases where the shapes of the incident surface and the emission surface of a lens having 10 characteristics change sharply when viewed in a cross-section in the main scanning direction. When the shape is restricted in this way, favorable imaging performance may not be obtained. In contrast, the imaging lens 406 does not have fθ characteristics, and the shapes of the incident surface and the emission surface viewed in a cross-section in the main scanning direction do not have many sharp changes, and as a result, favorable imaging performance can be obtained. Note that the imaging lens 406 may be a lens that has fθ characteristics in some portions in the main scanning direction, and does not have fθ characteristics in other regions.

Note that it is assumed that, in the following description, the surface potential (charged potential) (Vd) of the photosensitive member 4 charged by a charging unit that is not illustrated is −450 V, and the developing potential (Vdc) that a developing unit that is not shown in FIG. 1 outputs for development is −250 V. Also, it is assumed that the surface potential (exposure potential) (V1) of the photosensitive member 4 when all of the regions in one pixel has been exposed by the light beam 410 is −150 V. Furthermore, it is assumed that a temperature and humidity sensor, which is not illustrated, for detecting the ambient environment of the image forming apparatus is provided in the image forming apparatus.

Figure 3:
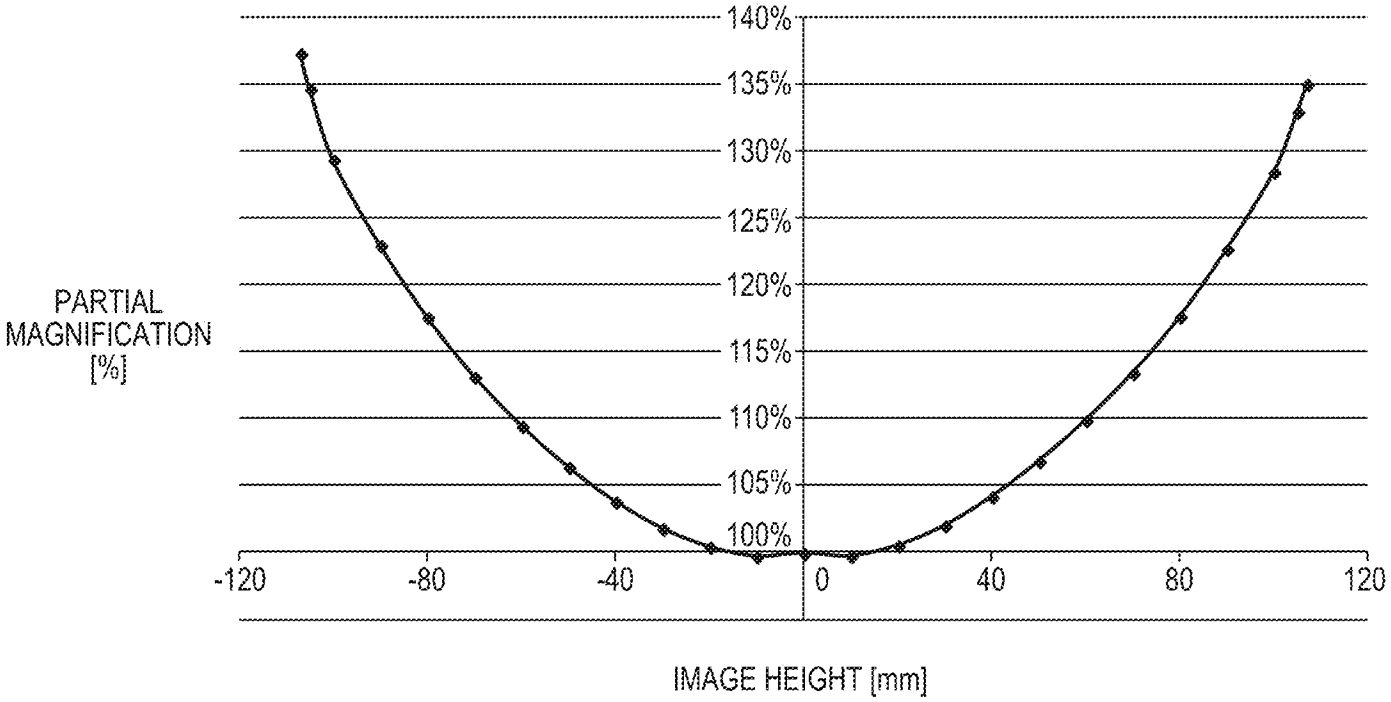
FIG. 3 is a diagram illustrating a relationship between an image height and a partial magnification according to one embodiment.

FIG. 3 shows a relationship between an image height and a partial magnification according to the present embodiment. Note that the image height 0 indicates a case where the spot is on the optical axis of the imaging lens 406, and is hereinafter referred to as an on-axis image height. Also, an image height other than the on-axis image height will be referred to as an off-axis image height. Furthermore, the image height having a maximum absolute value will be referred to as an outermost off-axis image height. As shown in FIG. 2A, the outermost off-axis image height in the scan surface 407 is W/2. In FIG. 3, a partial magnification of 130% at an image height, for example, means that the scan speed at the image height is 1.3 times the scan speed at an image height at which the partial magnification is 100%. In the example in FIG. 3, the scan speed at the on-axis image height is the lowest, and the scan speed increases as the absolute value of the image height increases. Therefore, if the pixel width in the main scanning direction is determined based on a fixed time interval determined by the clock cycle, the pixel width differs between the on-axis image height and the off-axis image height. Accordingly, in the present embodiment, partial magnification correction is performed. Specifically, the frequency of an image clock is corrected (image clock correction) according to the image height such that the pixel width is approximately the same regardless of the image height, and thus partial magnification correction is performed.

Also, the time taken for scanning a unit length at an image height in the vicinity of the outermost off-axis image height on the scan surface 407 is shorter than the time taken for scanning a unit length at an image height in the vicinity of the on-axis image height. This means that, when the emission luminance of the light source 401 is fixed, the total exposure amount per unit length (hereinafter, simply referred to as "exposure amount per unit length") at an image height in the vicinity of the outermost off-axis image height is smaller than the exposure amount per unit length at an image height in the vicinity of the on-axis image height. Therefore, in the present embodiment, luminance correction is performed in addition to partial magnification correction described above, in order to obtain preferable image quality.

Figure 4:
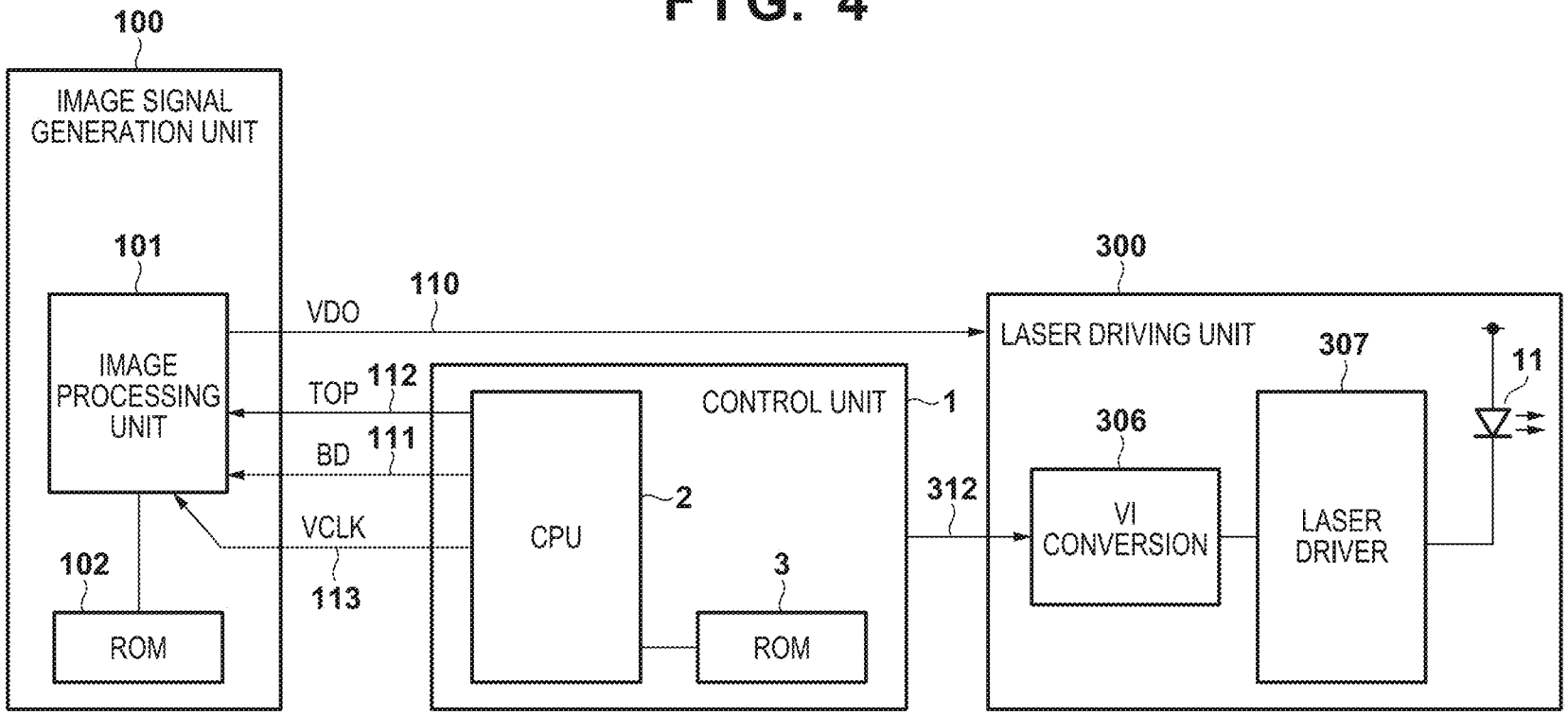
FIG. 4 is a diagram illustrating an exposure control configuration according to one embodiment.

FIG. 4 shows an exposure control configuration of the image forming apparatus 9. The image signal generation unit 100 receives image data from a host computer that is not illustrated, and generates a VDO signal 110, which is an image signal. Also, the image signal generation unit 100 has a function of correcting an image density. The control unit 1 performs overall control of the image forming apparatus 9. The laser driving unit 300 includes a laser driver 307. The laser driver 307 controls ON/OFF of light emission performed by a light emitting unit 11 of the light source 401 based on the VDO signal 110. The image signal generation unit 100 instructs the control unit 1 to start printing, when preparation for outputting the image signal for image formation is complete. The control unit 1 includes a CPU 2, and transmits, upon preparation for printing being complete, a TOP signal 112, which is a sub-scanning synchronization signal, and a BD signal 111, which is a main-scanning synchronization signal, to the image signal generation unit 100. The image signal generation unit 100, upon receiving these synchronization signals, outputs the VDO signal 110, which is the image signal, to the laser driving unit 300 at a predetermined timing. The image signal generation unit 100, the control unit 1, and the laser driving unit 300 will be described in detail later.

Figure 5A:
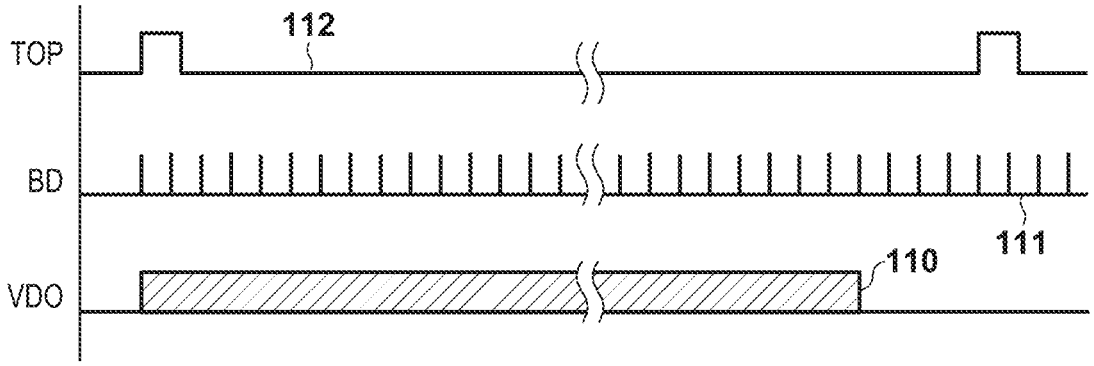
FIG. 5A is a diagram illustrating a relationship between signals according to one embodiment.

FIG. 5A is a diagram illustrating a relationship between signals. Note that time elapses from left to right in the diagram. "HIGH" of the TOP signal 112 indicates that the leading edge of the recording medium has reached a predetermined position. The image signal generation unit 100 transmits the VDO signal 110 in synchronization with the BD signal 111, upon receiving a "HIGH" TOP signal 112. The laser driving unit 300 causes the light source 401 to emit light to form an electrostatic latent image on the photosensitive member 4, based on the VDO signal 110. Note that, in FIG. 5A, the VDO signal 110 is shown as being continuously output over the span of a plurality of BD signals 111 in order to simplify the diagram. However, the VDO signal 110 is actually output for a predetermined period from when the BD signal 111 is output until the next BD signal 111 is output.

Partial Magnification Correction

Figure 5B:
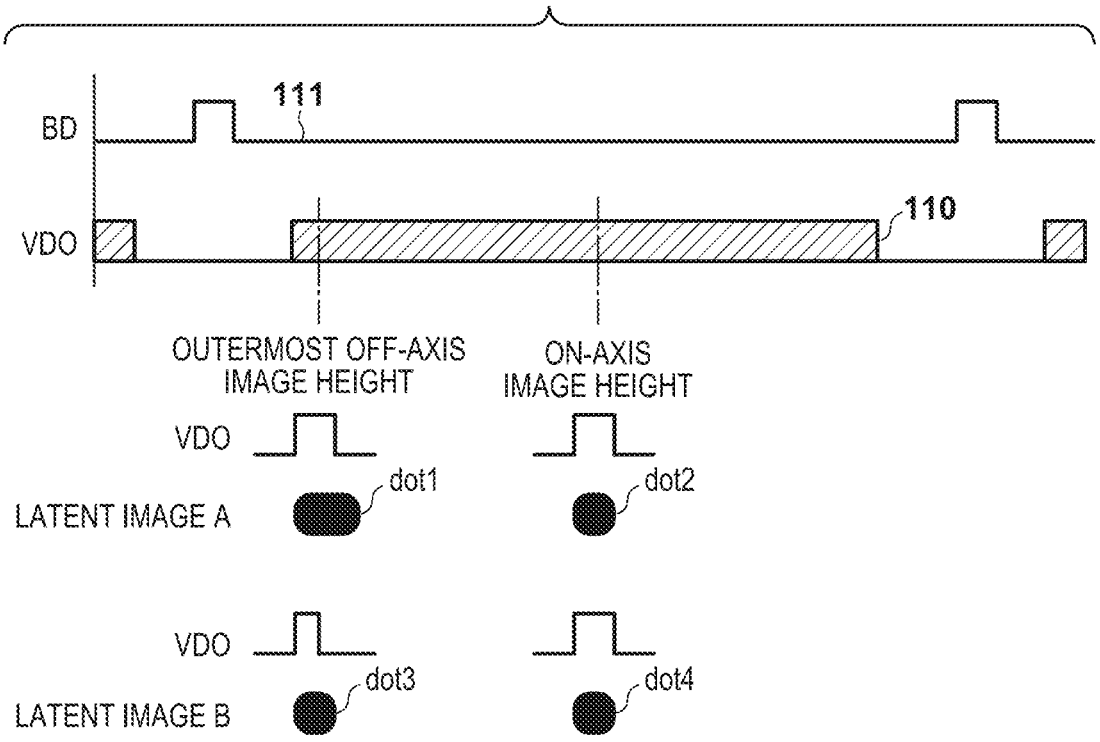
FIG. 5B is a diagram illustrating a relationship between an image height and a latent image according to one embodiment.

Next, the partial magnification correction will be described. Prior to the description, the reason why partial magnification correction is necessary and the correction principle will be described using FIG. 5B. The image signal generation unit 100, upon detecting the rising edge of the BD signal 111, transmits the VDO signal 110 after a predetermined timing in order to form a latent image at a position separated from the left end of the photosensitive member 4 by a desired distance. The optical scanning apparatus 400 has an optical configuration in which the scan speed at an end portion (outermost off-axis image height) is faster than that at a central portion (on-axis image height) on the scan surface 407, as described above. Therefore, as shown in a latent image A, a latent image dot1 at the outermost off-axis image height is enlarged in the main scanning direction relative to a latent image dot2 at the on-axis image height. The latent image dots dot1 and dot2 are formed when the light source 401 is caused to emit light in a period corresponding to one dot of 600 dpi (width of 42.3 μm in the main scanning direction) at the on-axis image height. Therefore, in the present embodiment, the cycle and time width of the VDO signal 110 are corrected according to the position in the main scanning direction, as partial magnification correction. That is, the light-emitting time interval at the outermost off-axis image height is reduced relative to the light-emitting time interval at the on-axis image height through partial magnification correction in order to make the latent image dot3 at the outermost off-axis image height have the same size as the latent image dot4 at the on-axis image height, as shown in latent image B. According to this correction, latent image dots corresponding to respective pixels can be formed substantively equidistantly at the same size.

The CPU 2 of the control unit 1 changes the frequency of a clock signal VCLK 113 that is transmitted to the image processing unit 101 of the image signal generation unit 100 according to the position in the main scanning direction in order to correct the cycle and time width of the VDO signal 110. With this, partial magnification correction is performed.

Figure 6:
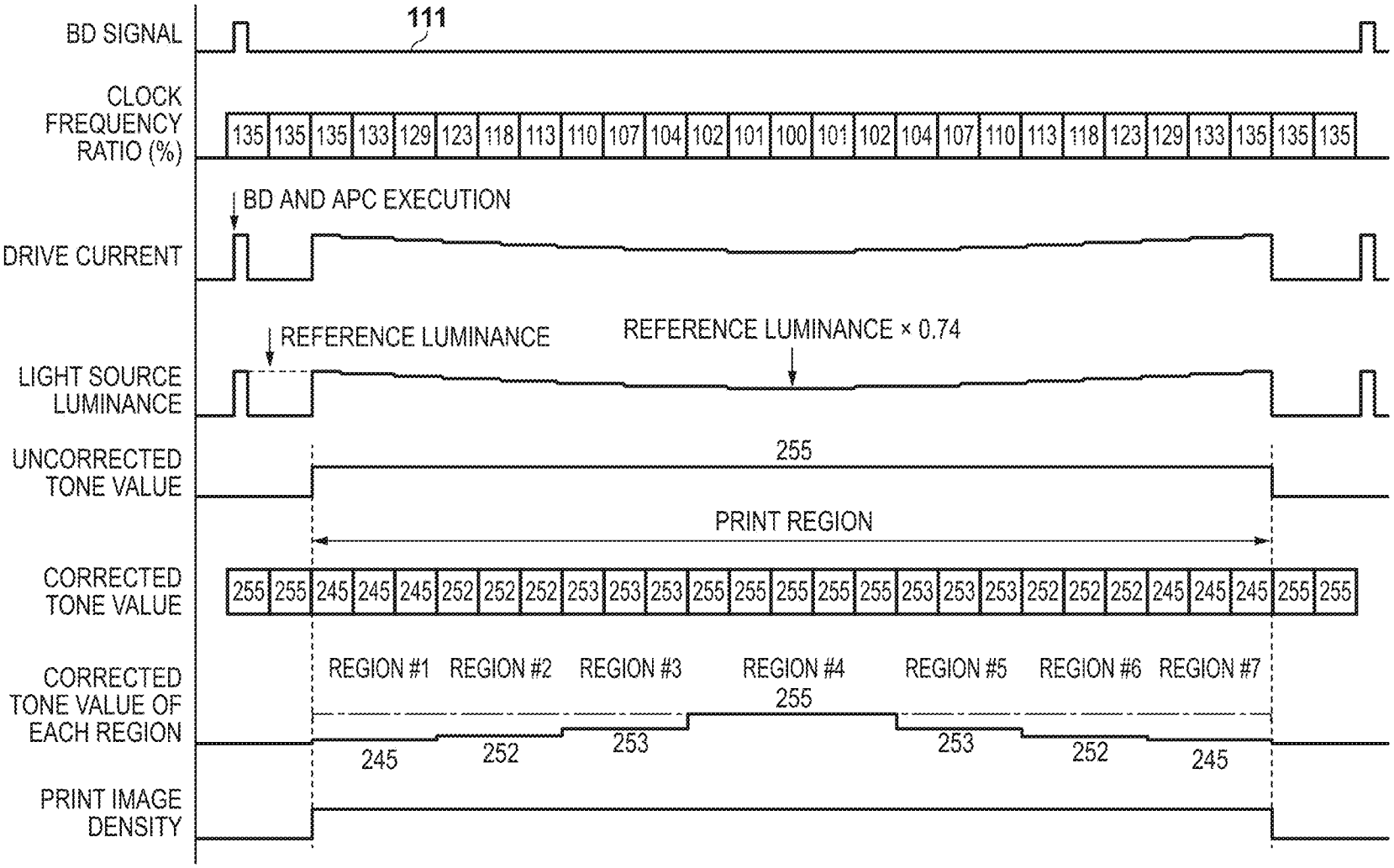
FIG. 6 is a diagram for describing partial magnification correction, luminance correction, and density correction according to one embodiment.

FIG. 6 shows an example of partial magnification correction. FIG. 6 shows partial magnification correction in the case where the scan speed at the outermost off-axis image height is 135% of that at the on-axis image height. Partial magnification correction information is stored in a ROM 3 shown in FIG. 4. The partial magnification correction information indicates a clock frequency ratio of the clock signal VCLK 113 in the main scanning direction. The CPU 2 transmits the clock signal VCLK 113 to the image processing unit 101 based on the partial magnification correction information so as to control the clock frequency. That is, the clock frequency ratio of the VDO signal 110 output from the image processing unit 101 is, when the ratio at the on-axis image height is defined as 100%, 135% at the outermost off-axis image height. Here, the time taken for a spot of the light beam 410 to move a distance of the width of one pixel (42.3 μm) on the scan surface 407 at the outermost off-axis image height is 0.74 times the time taken at the on-axis image height. According to this correction, pixel widths can be corrected and latent images corresponding to respective pixels can be formed substantively equidistantly at the same size in the main scanning direction.

Note that the partial magnification correction is not limited to the method in which the clock frequency ratio of the clock signal VCLK 113 is changed according to the partial magnification, as described above. For example, in a configuration in which exposure is performed in units of a pixel piece obtained by dividing one pixel into a plurality of pieces, partial magnification correction can be performed by inserting or omitting a pixel piece according to the partial magnification (image height).

Luminance Correction

Next, luminance correction will be described. The partial magnification correction described above performs correction such that exposure time for one pixel is reduced as the absolute value of the image height increases. Therefore, the total exposure amount (integrated light amount) for one pixel decreases as the absolute value of the image height increases. The luminance correction is performed to compensate this reduction. Specifically, the luminance (light emission intensity) of the light source 401 is corrected such that the total exposure amount (integrated light amount) for one pixel is the same regardless of the image height. The control unit 1 in FIG. 4 includes the CPU 2, a DA converter that is not illustrated, and a regulator that is not illustrated, which constitute a luminance correction unit along with the laser driving unit 300. The laser driving unit 300 includes a VI converter circuit 306 that converts a voltage to a current and a laser driver 307, and supplies a drive current to the light emitting unit 11 of the light source 401. Luminance correction information is also stored in the ROM 3. The luminance correction information is information indicating a relationship between a position in the main scanning direction and a correction current to be supplied to the light emitting unit 11.

The control unit 1 outputs a luminance correction analog voltage 312 that changes in one scan line in synchronization with the BD signal 111 based on the luminance correction information. The VI converter circuit 306 converts the luminance correction analog voltage 312 to a current and outputs the current to the laser driver 307. The laser driver 307 performs so-called APC (Auto Power Control), and automatically adjusts the luminance of the light emitting unit 11 to a desired luminance. Note that, as shown in FIG. 6, the APC is performed in a period in which the light emitting unit 11 is made to emit light, outside the print region, in order to detect the BD signal for each scan line. In this APC, a drive current is obtained that is to be made to flow to the light emitting unit 11 in order to obtain the desired brightness at the outermost off-axis image height. Hereinafter, the drive current at this time is referred to as a reference current, and the luminance of the light emitting unit 11 is referred to as a reference luminance. The CPU 2 controls a luminance correction analog voltage 312 according to the image height based on the luminance correction information stored in the ROM 3. The VI converter circuit 306 converts the luminance correction analog voltage 312 to a current, and outputs the correction current to the laser driver 307. The laser driver 307 corrects the luminance such that the luminance decreases as the absolute value of the image height decreases, as shown in FIG. 6, by reducing the correction current from the reference current. As a result, the brightness at the on-axis image height is 74% of that at the outermost off-axis image height, and correction is performed such that the total exposure amount (integrated light amount) for one pixel is constant regardless of the image height.

It was found that, in the configuration described above, particularly in a region in which the density is high (on solid side), the density increases as the image height increases, and as a result, the image density, including half tones, is not uniform in the main scanning direction. In the following, the reason why the density is not uniform in the main scanning direction will be described using a configuration in which only the partial magnification correction and luminance correction are performed, as Comparative example 1. Note that, in the present embodiment, it is assumed that the spot diameter is 60 μm at the on-axis image height, and is 90 μm at the outermost off-axis image height.

Figure 13A:
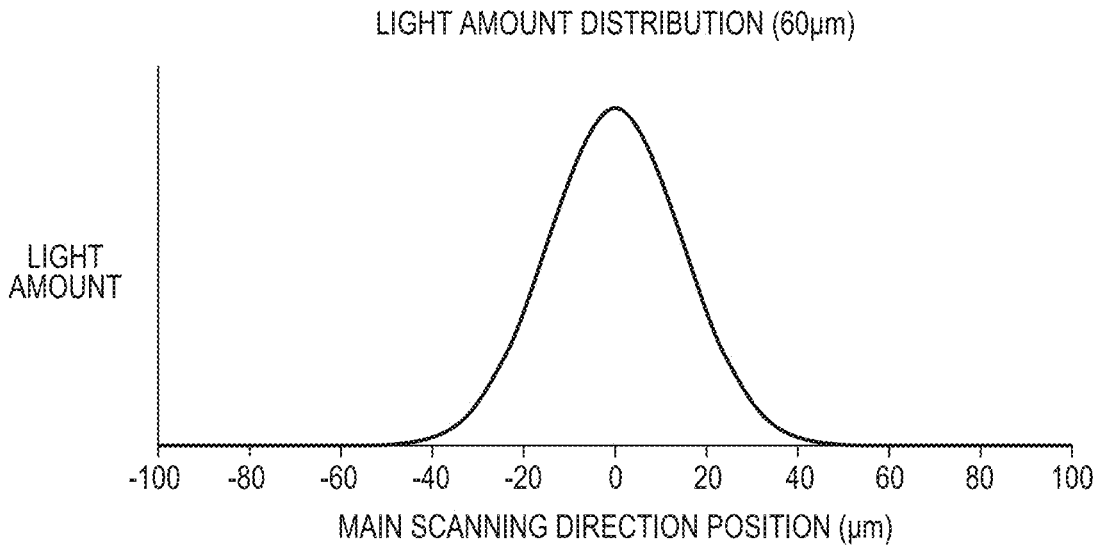
FIGS. 13A and 13B are diagrams illustrating a relationship between a spot diameter and a light amount distribution according to one embodiment.
Figure 13B:
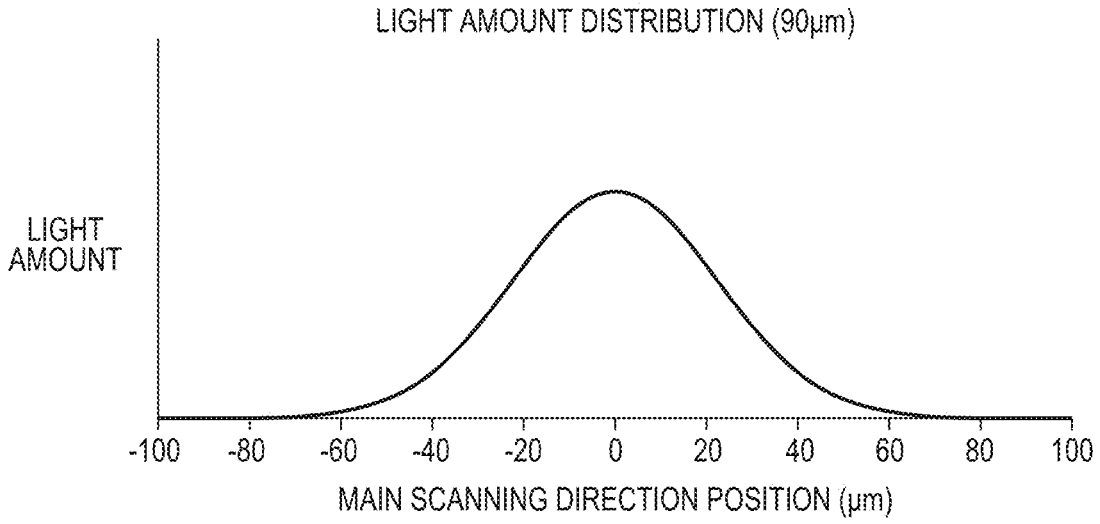
Figure 14A:
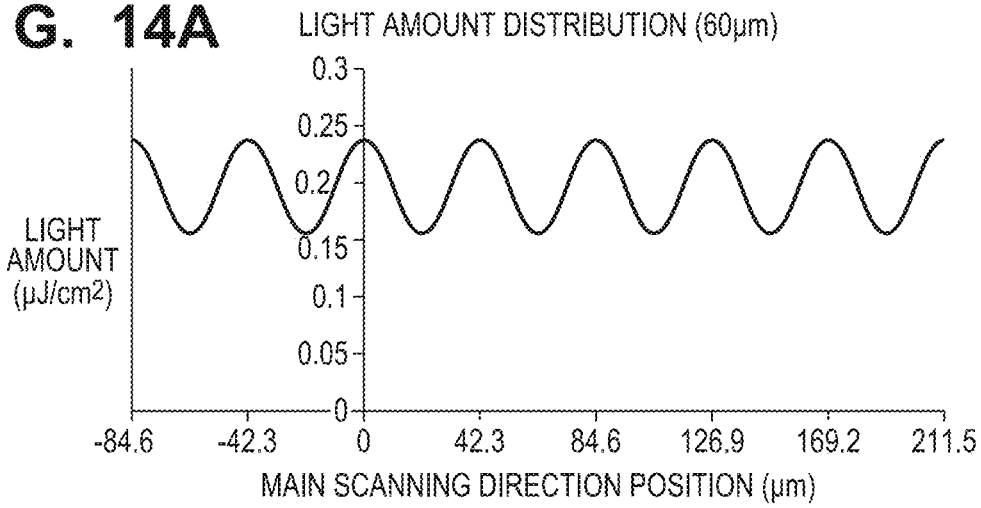
FIGS. 14A and 14B are diagrams illustrating a relationship between a spot diameter and a light amount distribution when light is continuously emitted according to one embodiment.
Figure 14B:
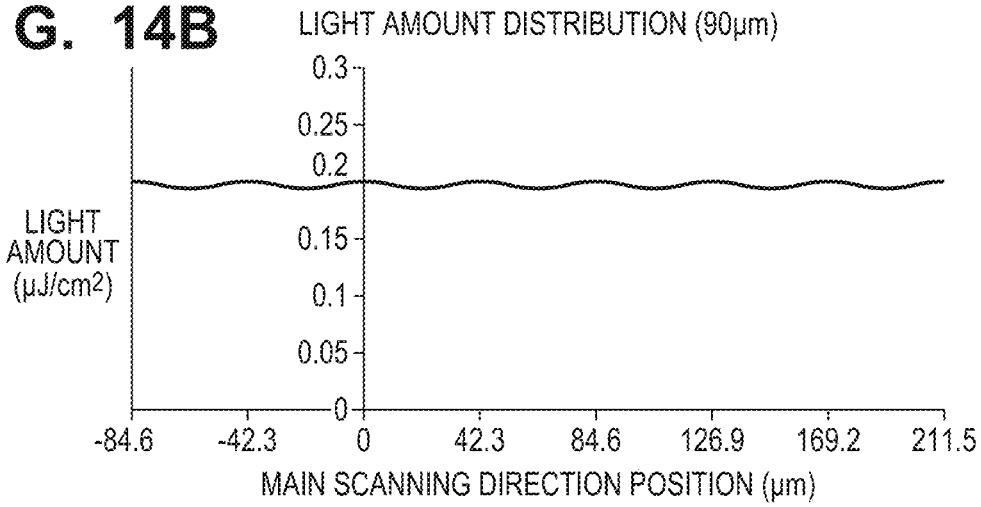

Comparative example 1 is a configuration in which luminance correction is performed such that the total exposure amount (integrated light amount) of one pixel is constant regardless of the image height. FIG. 18B shows changes in density in the main scanning direction for some tones in the configuration of Comparative example 1. As shown in FIG. 18B, in a region at which the tone value is large, the density increases as the image height increases. The reason why the density increases in a region in which the image height is high in the configuration of Comparative example 1 is as follows. Consider the exposure amount of the photosensitive member 4 when all of the pixels in the main scanning direction are exposed in order to form a solid image. FIG. 13A shows a light amount distribution on the scan surface 407 when the spot diameter at the on-axis image height is 60 μm, and FIG. 13B shows a light amount distribution on the scan surface 407 when the spot diameter at the outermost off-axis image height is 90 μm. The light amount distribution is approximated by Gaussian distribution. The light amount distribution of the photosensitive member 4 when a solid image is formed can be obtained by overlaying the light amount distribution corresponding to the spot diameter, which is shown in FIGS. 13A and 13B, while shifting the distribution by the pixel pitch. FIG. 14A shows a light amount distribution when the spot diameter is 60 μm, and FIG. 14B is a light amount distribution when the spot diameter is 90 μm. As shown in FIGS. 14A and 14B, when the spot diameter is 60 μm, the exposure amount changes by approximately ±20% due to the relationship between the pixel interval and the spot diameter. On the other hand, the exposure amount changes by approximately ±2% when the spot diameter is 90 μm.

Figure 15:
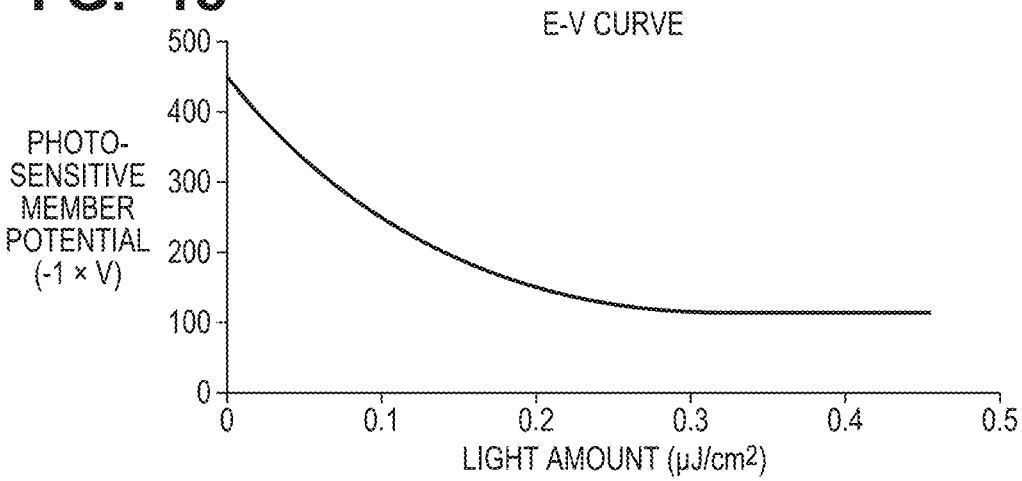
FIG. 15 is a diagram illustrating a relationship between an exposure amount of a photosensitive member and an exposure potential according to one embodiment.
Figure 16A:
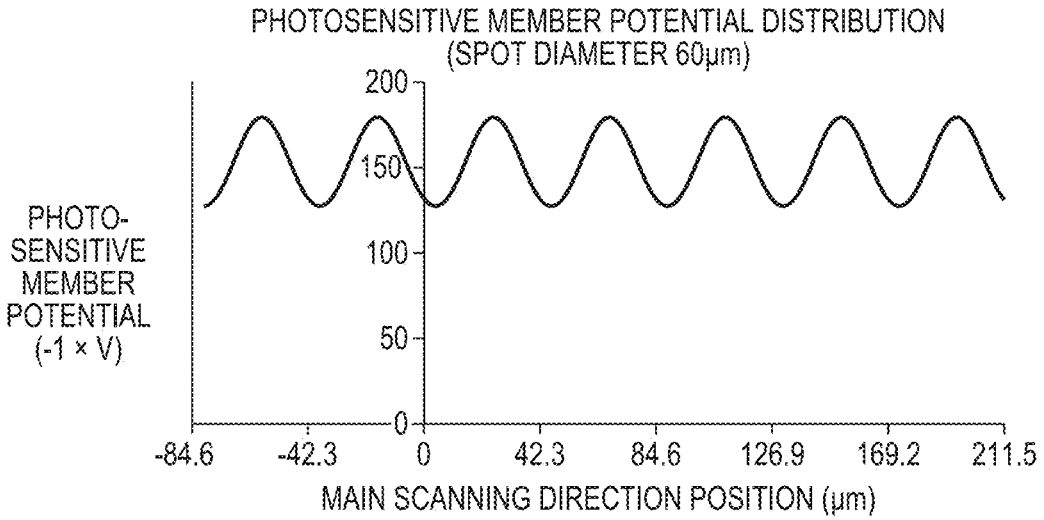
FIGS. 16A and 16B are diagrams illustrating a distribution of an exposure potential of the photosensitive member in a main scanning direction according to one embodiment.
Figure 16B:
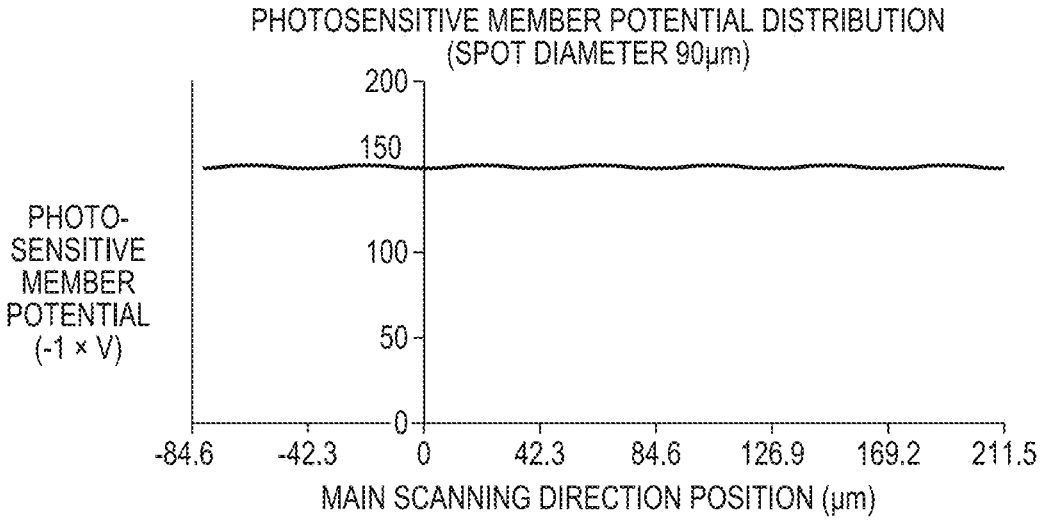

Next, consider the photosensitive member potential (exposure potential) of the photosensitive member 4 when the exposure amount changes. FIG. 15 shows a relationship between an exposure amount and a photosensitive member potential of the photosensitive member 4 (E-V curve). The exposure amount of the photosensitive member 4 is approximately 0.2 μJ/cm$^2$, and therefore the potential of the photosensitive member 4 is approximately −150V, but the value slightly changes depending on the spot diameter. FIG. 16A shows the potential distribution of the photosensitive member 4 when the spot diameter is 60 μm, and FIG. 16B shows the potential distribution of the photosensitive member 4 when the spot diameter is 90 μm.

When the spot diameter is 60 μm, the photosensitive member potential changes in a range from −130 to −180 V, approximately, and the average potential is −152.7 V. On the other hand, when the spot diameter is 90 μm, the photosensitive member potential changes in a range from −147 to −150 V, approximately, and the average potential is −148.7V. Therefore, the average potential differs by approximately 4 V between the spot diameter of 90 μm and the spot diameter of 60 μm. The developing potential (Vdc) is −250V, in the present embodiment, and the developing contrast is approximately 100V, and therefore, the contrast differs by approximately 4% (4 V) between the spot diameter of 90 μm and the spot diameter of 60 μm. As a result, the density changes in the main scanning direction due to this contrast difference.

In the present embodiment, density correction processing, which will be described in the following, is performed in order to suppress the density difference described above. FIG. 7 is a functional block diagram of the image processing unit 101. Image data from a host computer that is not illustrated is temporarily stored in a memory 103. A density correction processing unit 101*z* performs density correction processing (tone correction processing) on the image data, and outputs the processed image data to a half tone processing unit 101*a*. The half tone processing unit 101*a* performs multi-level dither processing (half-tone processing) on 8-bit (256 tones) image data for each pixel, and converts the 8-bit image data to 5-bit (32 tones) image data. A position control unit 101*b* adds 2-bit position control data that indicates the dot growth direction to the image data output from the half tone processing unit 101*a* using a position control matrix. A PWM control unit 101*c* generates the VDO signal 110, which is a pulse signal, based on the 7-bit image data to which the position control data has been added, and outputs the VDO signal 110 to the laser driving unit 300.

The half-tone processing performed by the half tone processing unit 101*a* will be described. The half tone processing unit 101*a* uses a dither matrix constituted by nine pixels (pixels a to i), that is, three pixels in the main scanning direction (left-right direction in the diagram) and three pixels in the sub-scanning direction (up-down direction in the diagram), as shown in FIG. 8. FIG. 9 is a table showing a relationship between an input tone value (pixel value) and an output level for each of the pixels a to i that constitute the dither matrix shown in FIG. 8.

The half tone processing unit 101*a* compares the tone value of each of the pixels a to i with threshold values, and outputs a corresponding level (0 to 31: 5 bits). For example, with respect to the pixel a, if the tone value is 144 or more, and less than 147, level 1 is output, and if the tone value is 147 or more, and less than 150, level 2 is output. That is, if the tone value is the threshold value associated with a certain level or more, and less than the threshold value associated with the level one level above the certain level, the certain level is output. Also, when the tone value is less than the threshold value associated with level 1, the half tone processing unit 101*a* outputs level 0. Also, with respect to the pixel a in FIG. 9, the threshold values associated with levels 17 to 31 are 181. In this case, if the tone value of the pixel a is 181 or more, the half tone processing unit 101*a* outputs level 31, which is the highest level.

The position control unit 101*b* includes a position control matrix shown in FIG. 10. The position control matrix is a table of position control data that is set so as to be associated with the pixels (pixels a to i) that constitute the dither matrix. The position control data takes one of three values, namely "R", "C", and "L", and is expressed by 2 bits. For example, the setting is such that R='01', C='00', and L='10'. "R", "C", and "L" each represent the position of a dot in a pixel and the growth direction of the dot. "R" indicates that the dot is arranged at a right end of a pixel and grows toward a left end, "C" indicates that the dot is arranged at a center of the pixel and grows toward both ends, and "L" indicates that the dot is arranged at a left end of the pixel and grows toward the right end. The position control unit 101*b* adds 2-bit position control data based on the position control data table to each of the pixels (5-bit data) that constitute each of the dither matrices of image data subjected to half-tone processing, and outputs 7-bit data for each pixel.

A PWM control unit 101*c* generates a pulse signal (VDO signal 110) corresponding to each pixel from the 7-bit data. FIG. 11 shows the relationship between the 2-bit position control data included in the 7-bit data, the 5-bit level included in the 7-bit data, and the pulse waveform generated by the PWM control unit 101*c*. The PWM value in FIG. 11 corresponds to the width of a pulse signal, and an integer value in a range from 0 to 255 is assigned to each of the levels 0 to 31. In the table shown in FIG. 11, settings are such that the pulse width increases as the level increases from level 0 (non-emission). At level 17, the PWM value is 255, and light is emitted over the entire pixel width. Also, the setting is such that, when the level further increases from level 17, the pulse width decreases. At level 24, the PWM value is 150. Also, the setting is such that, when the level further increases from level 24, the pulse width again increases. At level 31, the PWM value is 255, and light is emitted over the entire pixel width. Note that the tables shown in FIGS. 8, 9, 10, and 11 used for the image processing described above are pieces of information regarding the dither matrix provided for each tone, and are stored in a ROM 102 in the image processing unit 101.

Figure 12:
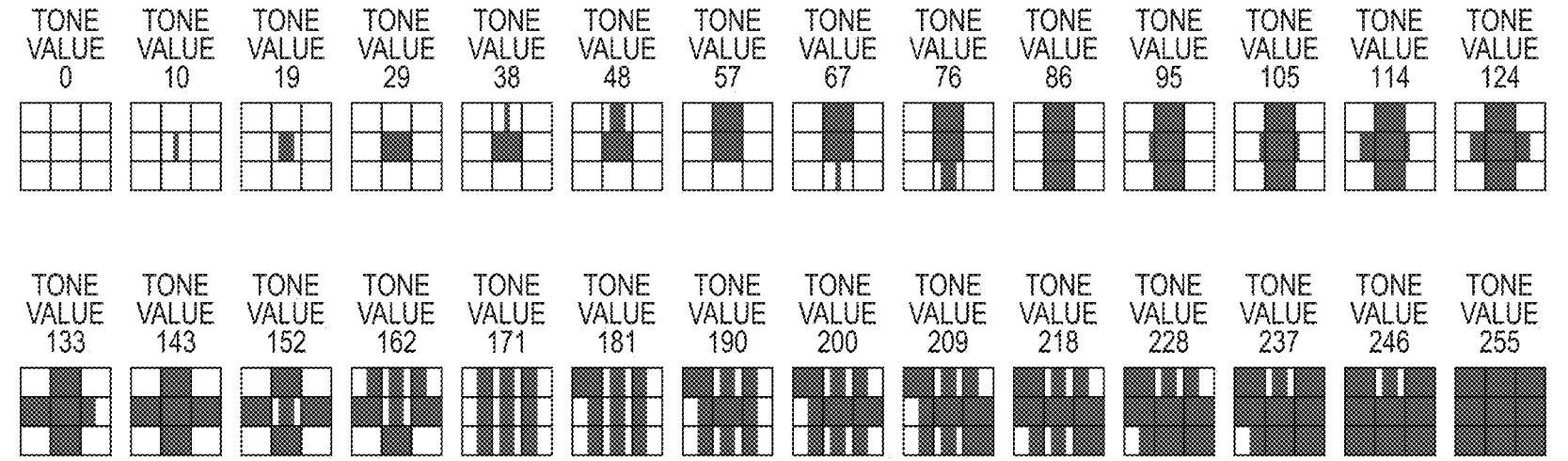
FIG. 12 is a dither growth diagram according to one embodiment.

FIG. 12 shows dither matrix light emission patterns for some tone values. One cell in the diagram represents one pixel. In FIG. 12, a black portion in each pixel indicates a region to be exposed. At tone value 0, all of the pixels are at level 0, and do not emit light. From tone value 0 to tone value 143, the pixels a, c, g, and i remain at level 0. Meanwhile, the levels of pixels b, d, e, f, and h advance, and the light emission width (exposed region) monotonously increases. At tone value 143, the pixels b, d, e, f, and h reach level 17, the PWM value is 255, and light is emitted over the entire pixel widths thereof. From tone value 143 to tone value 171, the levels of the pixels a, c, g, and i advance, and the light emission width monotonously increases. Meanwhile, in the pixels b, d, e, f, and h, the light emission width monotonously decreases.

At tone value 171, the pixels a, c, g, and i reach level 10, the PWM value is 150, and the pixels emit light. Also, the pixels b, d, e, f, and h reach level 24, the PWM value decreases to 150, and the pixels emit light. That is, all the pixels emit light at the PWM value 150. From tone value 171 to tone value 255, the levels of all the pixels advance, and the light emission width monotonously increases. At tone value 255, all of the pixels reach level 31, the PWM value is 255, and light is emitted over the entire pixel widths thereof.

Next, density correction performed by the density correction processing unit 101z will be described. In the present embodiment, density correction information used by the density correction processing unit 101z is stored in the ROM 102. The density correction processing unit 101z corrects the tone value according to the position of the pixel in the main scanning direction such that a change in the image density in the main scanning direction shown in FIG. 18B is suppressed. Note that the image density, here, means the density after printing is performed (fixed) on a recording material.

A specific example of the density correction processing will be described. The uncorrected tone value in FIG. 6 indicates tone values of pixels indicated by image data input to the density correction processing unit 101z. In FIG. 6, the uncorrected tone values of all the pixels in one scan line are 255 (solid image). The corrected tone value shows the tone value that has been corrected by the density correction processing unit 101z. In the present embodiment, one scan line is divided into seven regions #1 to #7 along the main scanning direction, and correction values of the tone value are assigned to the respective regions, the correction values of the tone value being the density correction information. Here, the regions #1 and #7 are regions at end portions in the main scanning direction that include the outermost off-axis image height. The regions #2 and #6 are respectively adjacent to the regions #1 and #7, and are regions closer to the on-axis image height than the regions #1 and #7. The regions #3 and #5 are respectively adjacent to the regions #2 and #6, and are regions closer to the on-axis image height than the regions #2 and #6. The region #4 is a region including the on-axis image height. Note that the region #4 is a region in which the image data is not changed, that is, a region for which a correction value is 0.

The density correction information is information indicating the reduction amounts of tone values for each region for which density is reduced. Note that the density correction information may also be information indicating the correction amounts (change amount) of tone values regardless of whether or not the density has changed. In this case, the correction amount is 0 for the region in which density has not changed. The information indicating the correction amount indicates a value by which the tone value is changed, or a change ratio of the tone value, for example. Also, the configuration may be such that the density correction information is provided for each uncorrected tone value. In the example in FIG. 6, the tone values in the regions #3 and #5 are reduced by 2 to 253. The tone values in the regions #2 and #6 are reduced by 3 to 252. The tone values in the regions #1 and #7 are reduced by 10 to 245. In this way, the density is reduced by increasing the reduction amount of the tone value from the on-axis image height toward the outermost off-axis image height. As a result of performing such density correction processing, the image density in the main scanning direction can be kept uniform as shown in the print image density in FIG. 6.

Figures 17A, 17B, 17C:
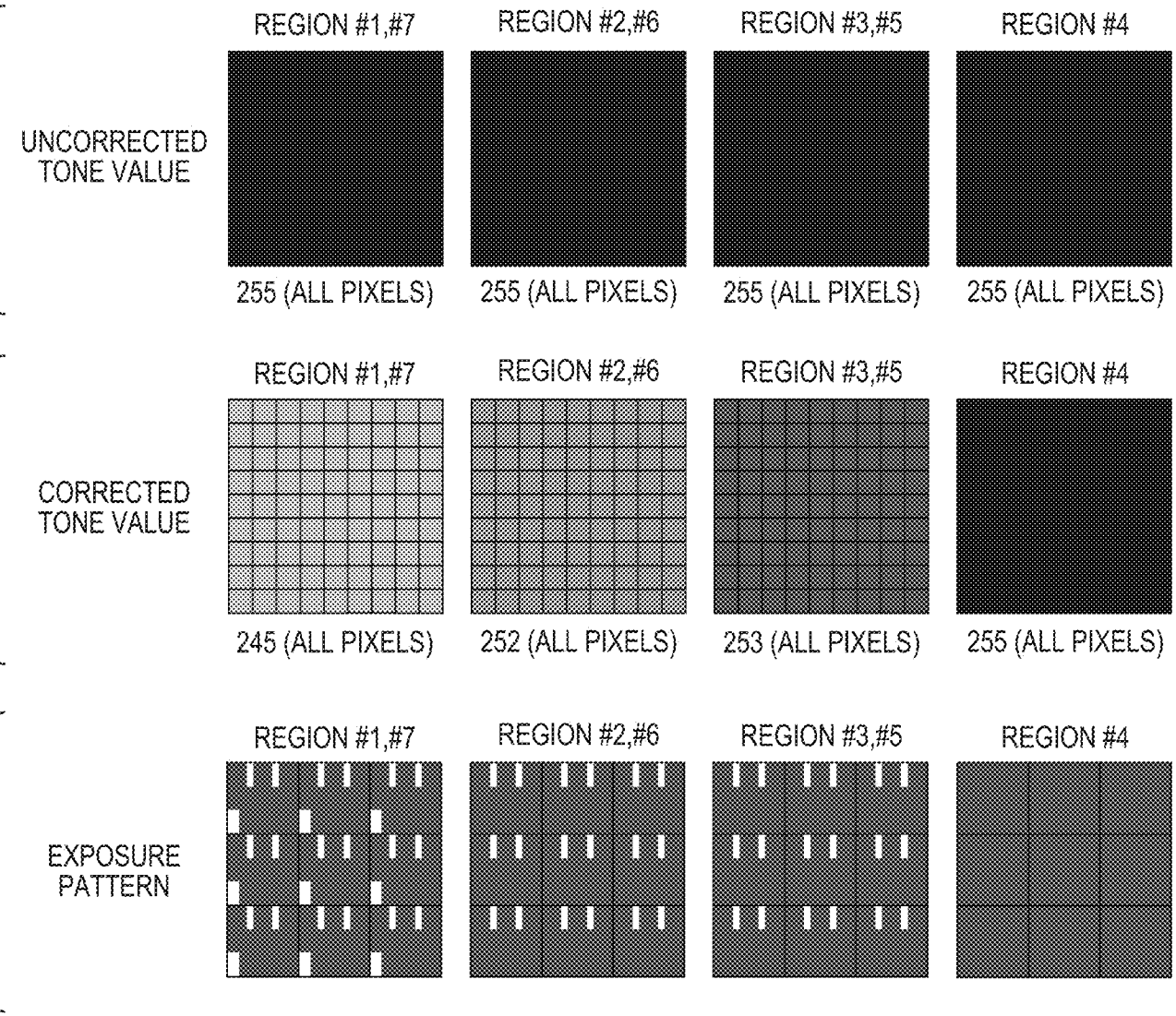
FIGS. 17A to 17C are diagrams illustrating exemplary processing of a solid image according to one embodiment.

FIGS. 17A to 17C are diagrams for describing processing when the tone values of all the pixels are 255, that is, when a so-called solid image is printed. One cell in the diagram represents one pixel, and the size thereof is 42.3 μm×42.3 μm in this example. FIG. 17A shows a range including nine dither matrices. As shown in FIG. 17A, the uncorrected tone values are 255 for all the pixels. FIG. 17B shows tone values subjected to the density correction processing, and the tone values are changed according to the regions, as shown in the diagram. FIG. 17C shows the exposure region (light emission pattern) in each pixel obtained based on the corrected tone value. As shown in FIG. 17C, in the region #4, each of the pixels are exposed at PWM value 255 (full width). In the regions #3 and #5, some pixels are exposed at PWM value 225, and the remaining pixels are exposed at PWM value 255. In the regions #2 and #6, some pixels are exposed at PWM value 240, and the remaining pixels are exposed at PWM value 255. In the regions #1 and #7, some pixels are exposed at PWM value 240, some other pixels are exposed at PWM value 150, and the remaining pixels are exposed at PWM value 255 (full width).

Figure 18A:
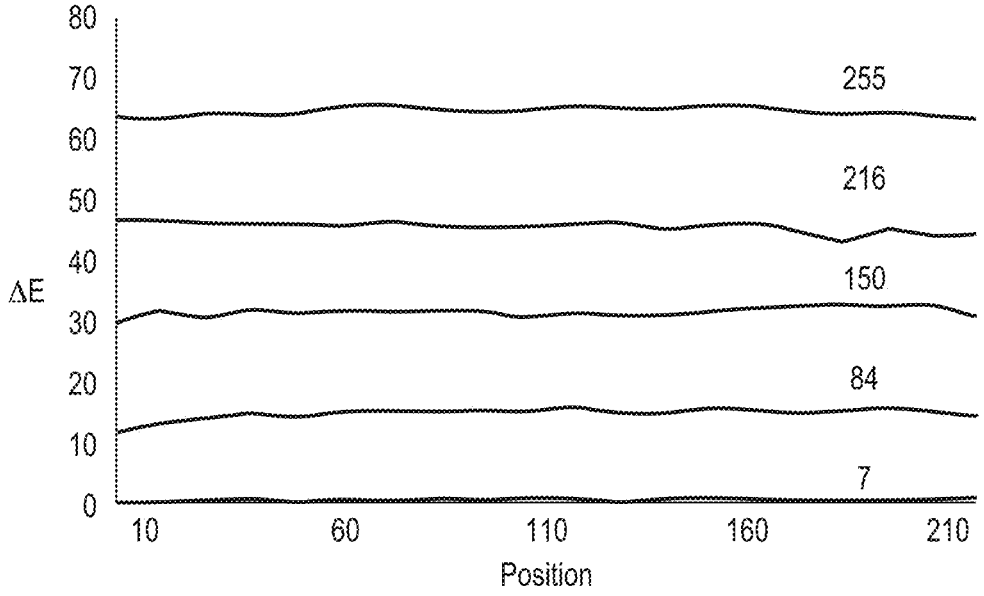
FIG. 18A is a diagram illustrating a density change of a printed image in the main scanning direction according to a first embodiment.
Figure 18B:
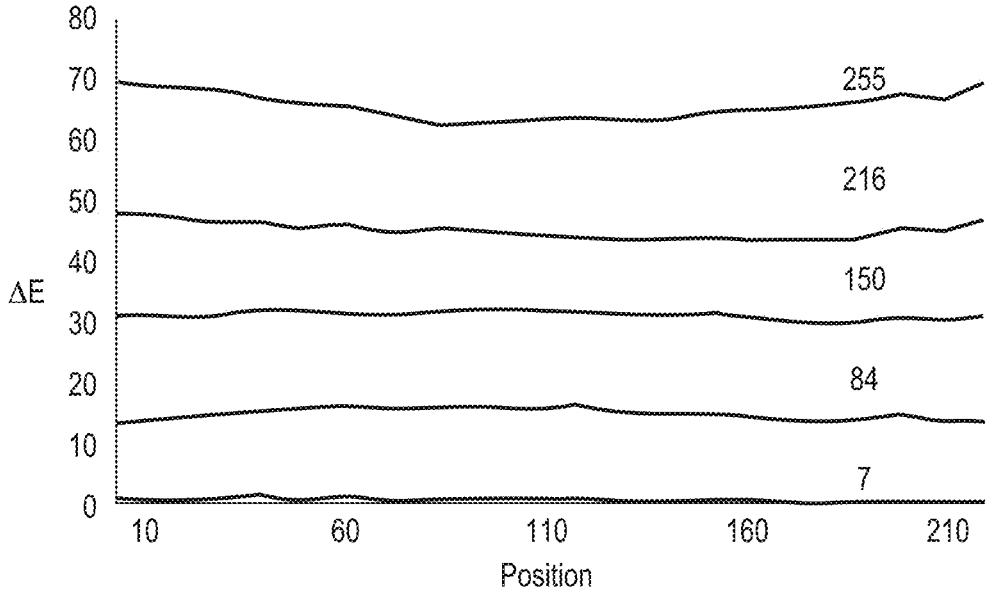
FIG. 18B is a diagram illustrating a density change of a printed image in the main scanning direction according to Comparative example 1.

FIG. 18A shows changes in density, for some tone values, in the main scanning direction in the case where the density correction processing according to the present embodiment has been performed. In FIG. 18B, which is a comparative example, only partial magnification correction and luminance correction are performed, and therefore, the density increases at an end portion in the main scanning direction in a region in which the tone value is large, as described above. In the present embodiment, density correction for changing the tone value is performed in addition to partial magnification correction and luminance correction, and as a result, the change in density in the main scanning direction can be reduced even in a region in which the tone value is large.

As described above, in the present embodiment, the optical scanning apparatus 400 is configured to scan the photosensitive member 4 with light whose scan speed changes according to the image height. Therefore, the control unit 1 performs partial magnification correction and luminance correction. Furthermore, the density correction processing unit 101z corrects the tone value based on density correction information in order to suppress the change in density caused by the change in the spot diameter of scan light on the photosensitive member 4 according to the image height. According to this configuration, the change in density in the main scanning direction, due to the configuration of the optical scanning apparatus 400, can be reduced. Note that the density correction information is created in advance and is stored in the ROM 101.

Second Embodiment

Figure 24:
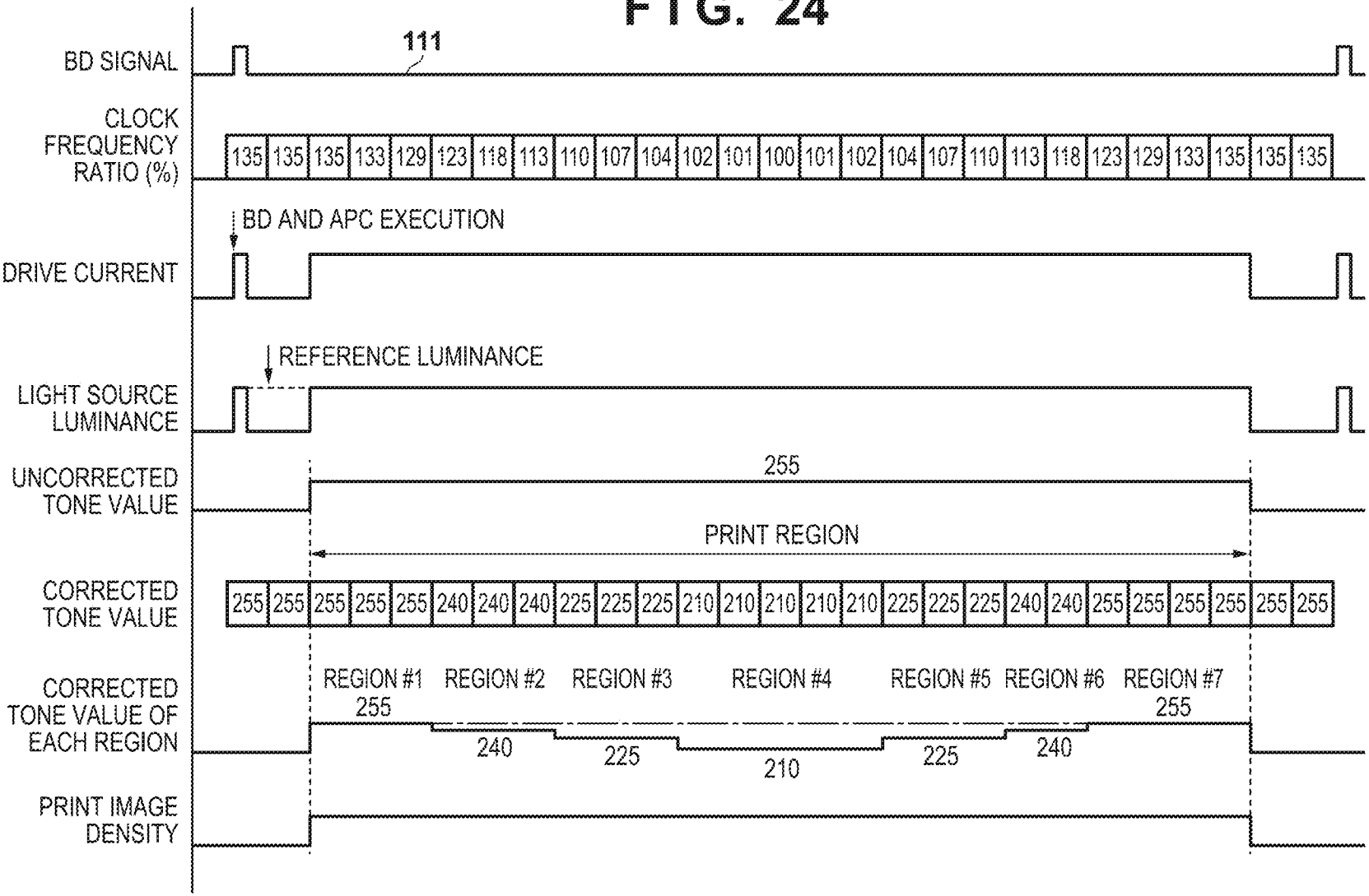
FIG. 24 is a diagram for describing partial magnification correction and density correction according to one embodiment.

Next, a second embodiment will be described focusing on differences with the first embodiment. In the present embodiment, luminance correction is not performed. Therefore, the reference current determined by the APC need not to be corrected using the luminance correction analog voltage 312, and as a result, the exposure control configuration can be simplified. Since the luminance correction is not performed, the total exposure amount (integrated light amount) of one pixel at the outermost off-axis image height is 74%, when the total exposure amount at the on-axis image height is assumed to be 100%, as described in the first embodiment. In the present embodiment, the change in the total exposure amount is also cancelled out by density correction processing. That is, the luminance correction in the first embodiment is incorporated in the density correction in the first embodiment. FIG. 24 shows the density correction in the present embodiment. Note that, since luminance correction is not performed, as described above, the light source luminance is constant at the reference luminance. In the present embodiment, the tone value is not changed in the regions #1 and #7. On the other hand, in other regions, the tone value is reduced, and the image density is reduced. In FIG. 24, the corrected tone value is 240 in the regions #2 and #6, 225 in the regions #3 and #5, and 210 in the region #4. The tone value in the region #4 is 82% of the tone value in the region #1, and is larger than 74%, which is the reduction amount of an exposure amount when luminance correction is performed. This is because an increase in the density at an end portion in the main scanning direction due to the change in the spot diameter, as described in the first embodiment, is taken into consideration.

As described above, in the present embodiment, the optical scanning apparatus 400 is configured to scan the photosensitive member 4 with light whose scan speed changes according to the image height. Here, the present embodiment differs from the first embodiment in that the control unit 1 performs partial magnification correction, but does not perform luminance correction. Therefore, in the present embodiment, a change in density occurs that combines the change in density in the main scanning direction caused by the change in the exposure amount of the photosensitive member 4 due to the change in the scan speed, and the change in density caused by the change in the spot diameter of scan light on the photosensitive member 4 according to the image height. Therefore, the density correction information for suppressing this change in density is created, and is stored in the ROM 101 in advance. Also, the density correction processing unit 101*z* corrects the tone value based on the density correction information. According to this configuration, the change in density in the main scanning direction due to the configuration of the optical scanning apparatus 400 can be reduced. Note that, in the present embodiment, both the change in the exposure amount of the photosensitive member 4 due to the change in the scan speed, and the change in the exposure amount of the photosensitive member 4 caused by the change in the spot diameter of scan light on the photosensitive member 4 according to the image height are suppressed by correcting the tone value. However, a configuration can be adopted in which the change in the exposure amount of the photosensitive member 4 due to these two factors is suppressed by luminance correction. In this case, the density correction processing unit 101*z* can be omitted.

Third Embodiment

Next, a third embodiment will be described focusing on differences with the first embodiment. In the present embodiment, a toner projection development method is used as the development method. An imaging lens 406 of an optical scanning apparatus 400 according to the present embodiment has fθ characteristics. That is, the spot moves at a uniform speed on the scan surface 407 when the deflector 405 is rotated at a uniform angular velocity. Therefore, in the present embodiment, partial magnification correction and luminance correction need not to be performed.

Figure 19A:
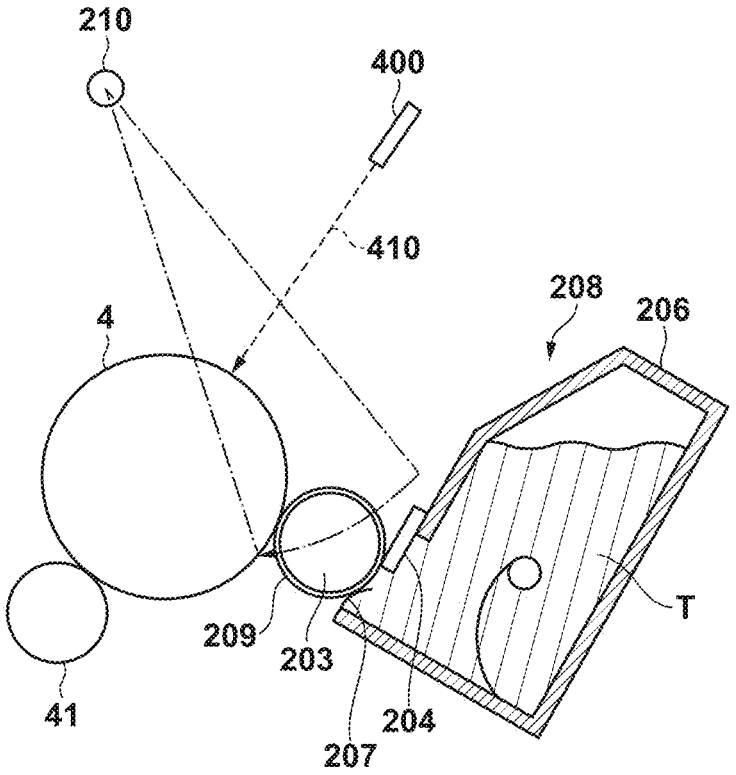
FIGS. 19A and 19B are configuration diagrams of a developing unit according to one embodiment.

FIG. 19A is a configuration diagram of a developing unit 208 according to the present embodiment. The developing unit 208 uses a toner projection development method using magnetic one-component toner as the developer. The developing unit 208 includes a toner storage container 206 as its frame body. Toner T is stored inside the storage container 206. Also, the storage container 206 supports members of the developing unit 208. A developing sleeve 203 is rotatably supported by the storage container 206, and is rotationally driven counterclockwise in the diagram. A restricting blade 204 supported by the storage container 206 regulates the thickness of a toner layer on the developing sleeve 203, and charges toner particles carried by the developing sleeve 203. Furthermore, the storage container 206 is provided with a sheet member 207 for preventing toner T from scattering through the gap between the developing sleeve 203 and the storage container 206.

The toner T inside the storage container 206 is drawn toward the developing sleeve 203 by a magnetic force of a magnet roller (unshown) inside the developing sleeve 203 and is held thereon. The toner T held on the developing sleeve 203 is carried to the restricting blade 204, charged by the restricting blade 204 rubbing against the developing sleeve 203, and is held on the developing sleeve 203. Distance restricting members 209 are provided at both end portions of the developing sleeve 203 in order to keep the distance uniform between the developing sleeve 203 and the photosensitive member 4 at a predetermined distance. A developing bias is applied in a region in which the developing sleeve 203 approaches the photosensitive member 4 by a high-voltage power supply that is not illustrated, and the latent image on the photosensitive member 4 is developed with the toner T on the developing sleeve 203. Also, the developing unit 208 is rotatable about a coupling member 210. The developing sleeve 203 is configured to be pressed toward the photosensitive member 4 with the distance restricting member 209 being interposed therebetween by a biasing member that is not illustrated and the weight of the developing unit 208.

Figure 19B:
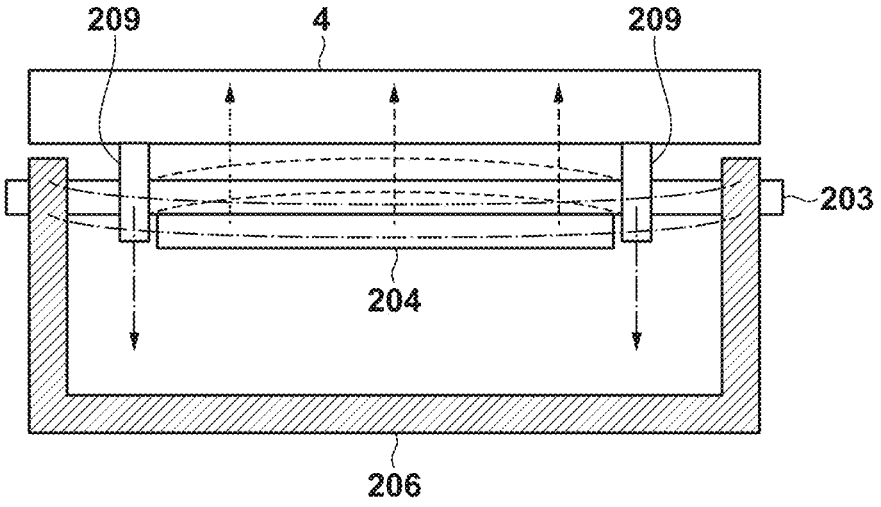

FIG. 19B is a diagram illustrating forces applied to the developing sleeve 203 and a deforming direction in a region in which developing sleeve 203 and the photosensitive member 4 are close to each other. The developing sleeve 203 is subjected to a pressing force from the restricting blade 204 toward the photosensitive member 4 (shown by dotted arrows in the diagram) and a pressing force from the photosensitive member 4 in a direction opposite to the photosensitive member 4 via the distance restricting member 209 (shown by one dot chain line arrows in the diagram). The pressing force from the restricting blade 204 acts on the developing sleeve 203 such that the central portion thereof deforms toward the photosensitive member 4 (shown by dotted lines in the diagram), and the pressing force from the photosensitive member 4 acts on the developing sleeve 203 such that the end portions deform in a direction opposite to the photosensitive member 4 (shown by one dot chain line arrows in the diagram). As a result of these forces, the central portion of the developing sleeve 203 deforms toward the photosensitive member 4 as a whole. This deformation increases as the diameter of the developing sleeve 203 decreases or the like, and increases as the strength thereof decreases. In order to meet a demand for reducing the size of the image forming apparatus, the diameter of the developing sleeve 203 is small, and as a result, the distance between the photosensitive member 4 and the developing sleeve 203 is not uniform in the main scanning direction. That is, the distance at the central portion in the main scanning direction is smaller than that at the end portions, and the density at the central portion increases relative to that in the end portions.

Figure 25:
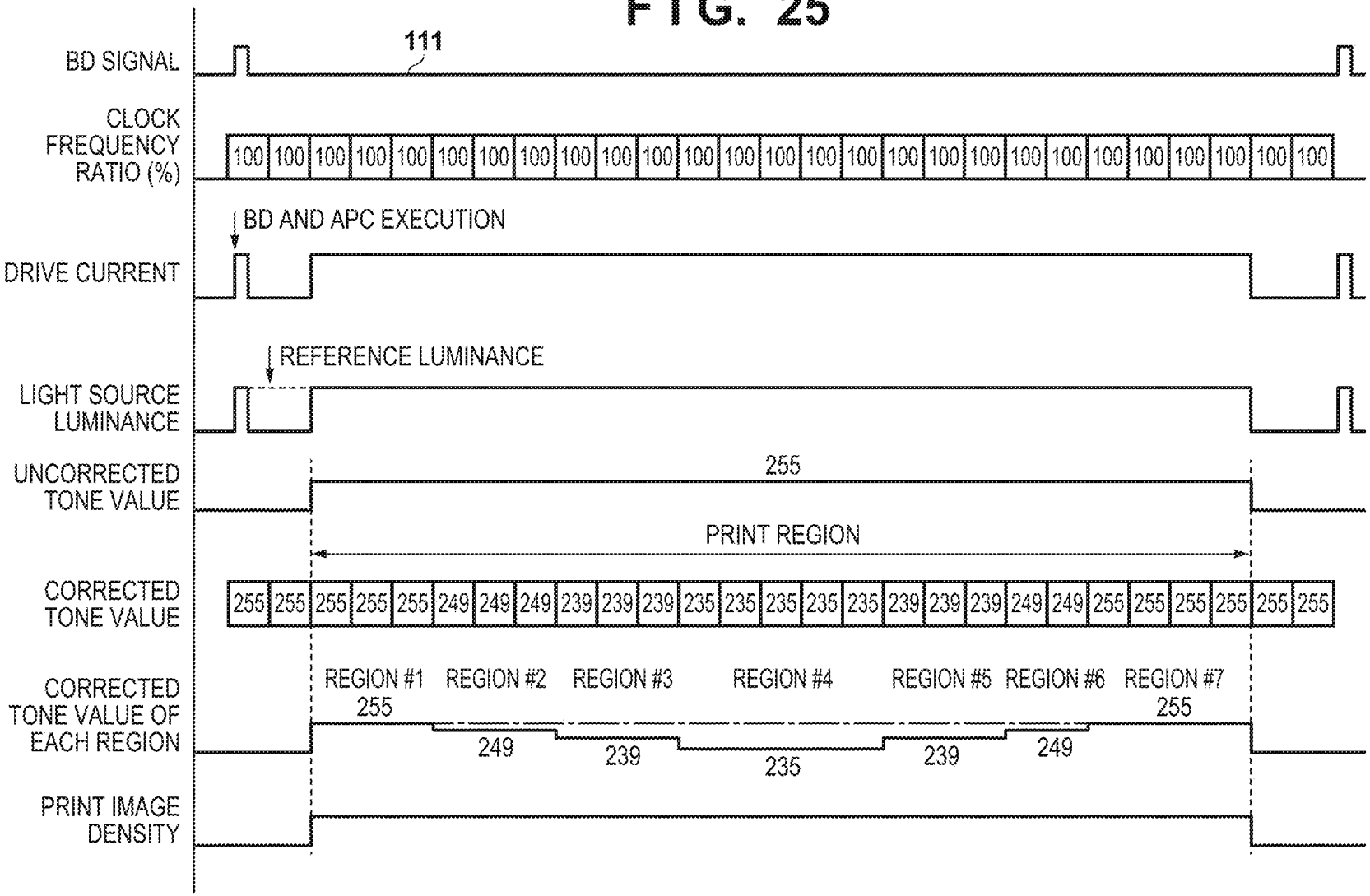
FIG. 25 is a diagram for describing density correction according to one embodiment.

In the present embodiment as well, one scan line is divided into seven regions along the main scanning direction, and correction amounts are assigned to the respective regions, similarly to the first embodiment. With this, the change in density caused by the fact that the distance between the developing sleeve 203 and the photosensitive member 4 is not uniform in the main scanning direction is corrected. FIG. 25 is a diagram for describing the density correction according to the present embodiment, and shows a case where all of the uncorrected tone values are 255, similarly to the embodiment described above. Note that, as described above, partial magnification correction and luminance correction need not be performed, and therefore the clock frequency and the light source luminance are fixed. In the present embodiment, the corrected tone values in the regions #1 and #7 are 255. Also, the corrected tone values in the regions #2 and #6 are 249, the corrected tone values in the regions #3 and #5 are 239, and the corrected tone value in the region #4 is 235. As a result of reducing the tone value toward the central portion in the main scanning direction by increasing the correction amount, the change in density in the main scanning direction can be reduced.

Figure 20A:
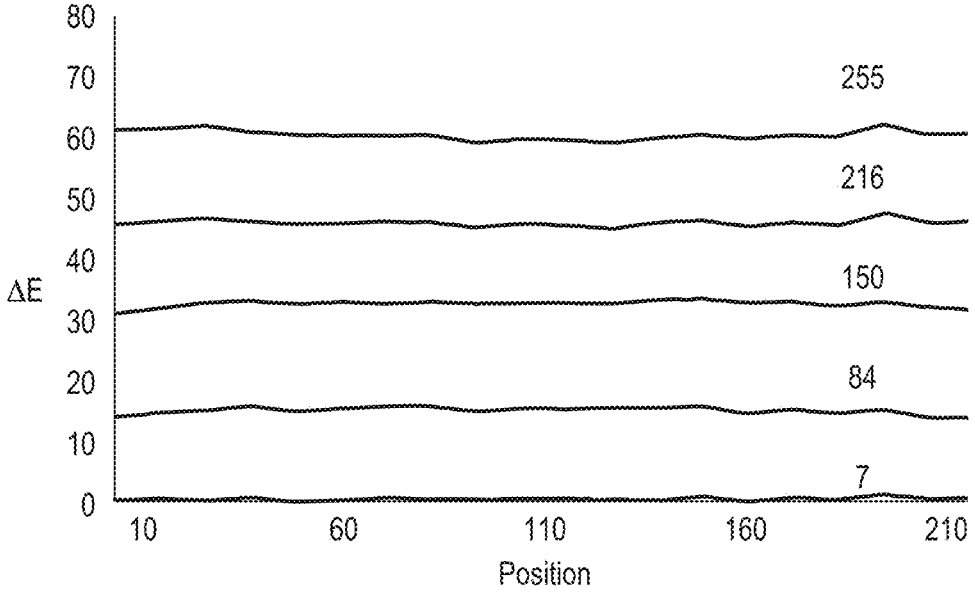
FIG. 20A is a diagram illustrating a density change of a printed image in the main scanning direction according to a third embodiment.
Figure 20B:
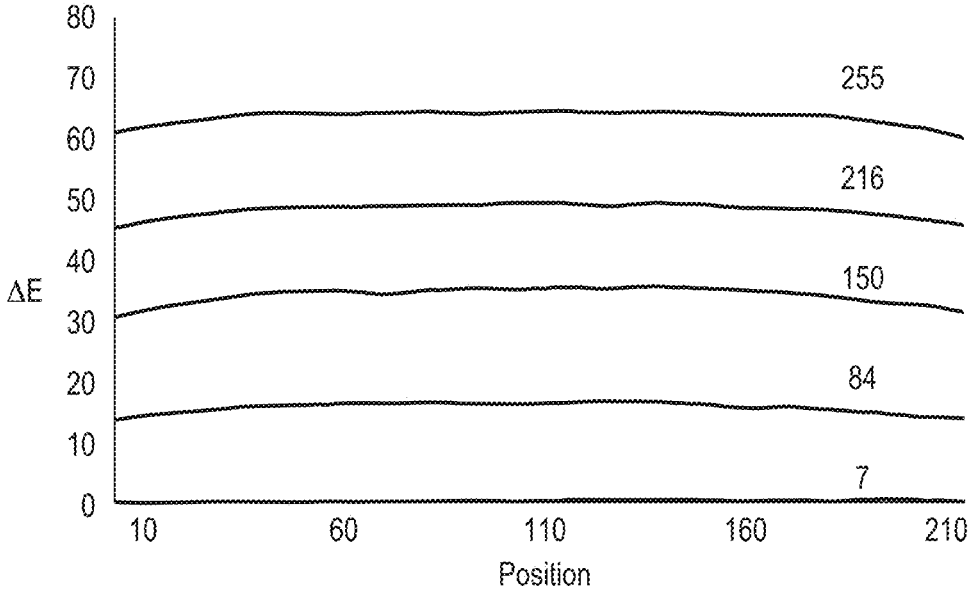
FIG. 20B is a diagram illustrating a density change of a printed image in the main scanning direction according to Comparative example 2.

FIG. 20A shows changes in density in the main scanning direction for some tones in the configuration of the present embodiment. As a result of the density correction described above, the difference in developability caused by the nonuniformity in distance between the developing sleeve 203 and the photosensitive member 4 in the main scanning direction is reduced, and therefore the change in density in the main scanning direction can be suppressed. FIG. 20B shows changes in density in the main scanning direction for some tones in the configuration of Comparative example 2 in which density correction processing is not performed and printing is performed using the input tone values as is. The density decreases at the end portions in the main scanning direction due to the change in distance between the developing sleeve 203 and the photosensitive member 4 in the main scanning direction.

As described above, the optical scanning apparatus 400, in the present embodiment, is configured to scan the photosensitive member 4 at a fixed speed regardless of the image height. Meanwhile, the developing unit 208 is configured such that the developing sleeve 203 does not come into contact with the photosensitive member 4. In this configuration, nonuniformity in distance between the developing sleeve 203 and the photosensitive member 4 in the main scanning direction may occur, as described above. Also, a change in density in the main scanning direction due to this nonuniformity may occur. Therefore, density correction information is created and stored in the ROM 101 in advance in order to suppress this change in density. Then, the density correction processing unit 101*z* corrects the tone values based on the density correction information. According to this configuration, the change in density in the main scanning direction due to the configuration of the developing unit 208 can be reduced. Note that, in the present embodiment as well, a configuration can be adopted in which the change in density in the main scanning direction caused by the nonuniformity in distance between the developing sleeve 203 and the photosensitive member 4 in the main scanning direction is suppressed by performing luminance correction. In this case, the density correction processing unit 101*z* can be omitted.

Note that the present embodiment can be combined with the first embodiment or the second embodiment. That is, the present embodiment can also be applied to a case where the optical scanning apparatus 400 that does not have fθ characteristics is used. For example, in a configuration in which the present embodiment is combined with the first embodiment, density correction information is created such that the change in density, which is a combination of the change in density in the main scanning direction caused by the change in the spot diameter of scan light due to the image height and the change in density in the main scanning direction due to the nonuniformity in distance between the developing sleeve 203 and the photosensitive member 4 in the main scanning direction, is suppressed, and the density correction information is stored in the ROM 101 in advance. Also, in a configuration in which the present embodiment is combined with the second embodiment, density connection information is created in which the change in density in the main scanning direction caused by the change in the exposure amount in the main scanning direction is also considered, and the density correction information is stored in the ROM 101 in advance. In the case where only luminance correction is performed, a similar idea can also be applied.

Fourth Embodiment

Next, a fourth embodiment will be described focusing on differences with the first embodiment. There are cases where the developing unit 208 does not have uniform developing characteristics in the main scanning direction due to several factors, regardless of the method of development. For example, the flowability of toner is likely to decrease on an end portion side in the main scanning direction in the storage container 208 relative to that in a central portion, and the density on the end portion in the main scanning direction may decrease relative to that in the central portion. In the first embodiment, density correction is performed in addition to partial magnification connection and luminance correction for compensating nonuniformity due to the configuration (characteristics) of the optical scanning apparatus 400 and the exposure control characteristics when the optical scanning apparatus 400 is used. In the present embodiment, nonuniformity in density due to the configuration of the developing unit is also corrected in this density correction. In this case, characteristics (first embodiment) in which the density increases in end portions in the main scanning direction and characteristics in which the density increases in a central portion in the main scanning direction are combined to have complex characteristics. However, density correction information can be set in accordance with the characteristics.

Figure 26:
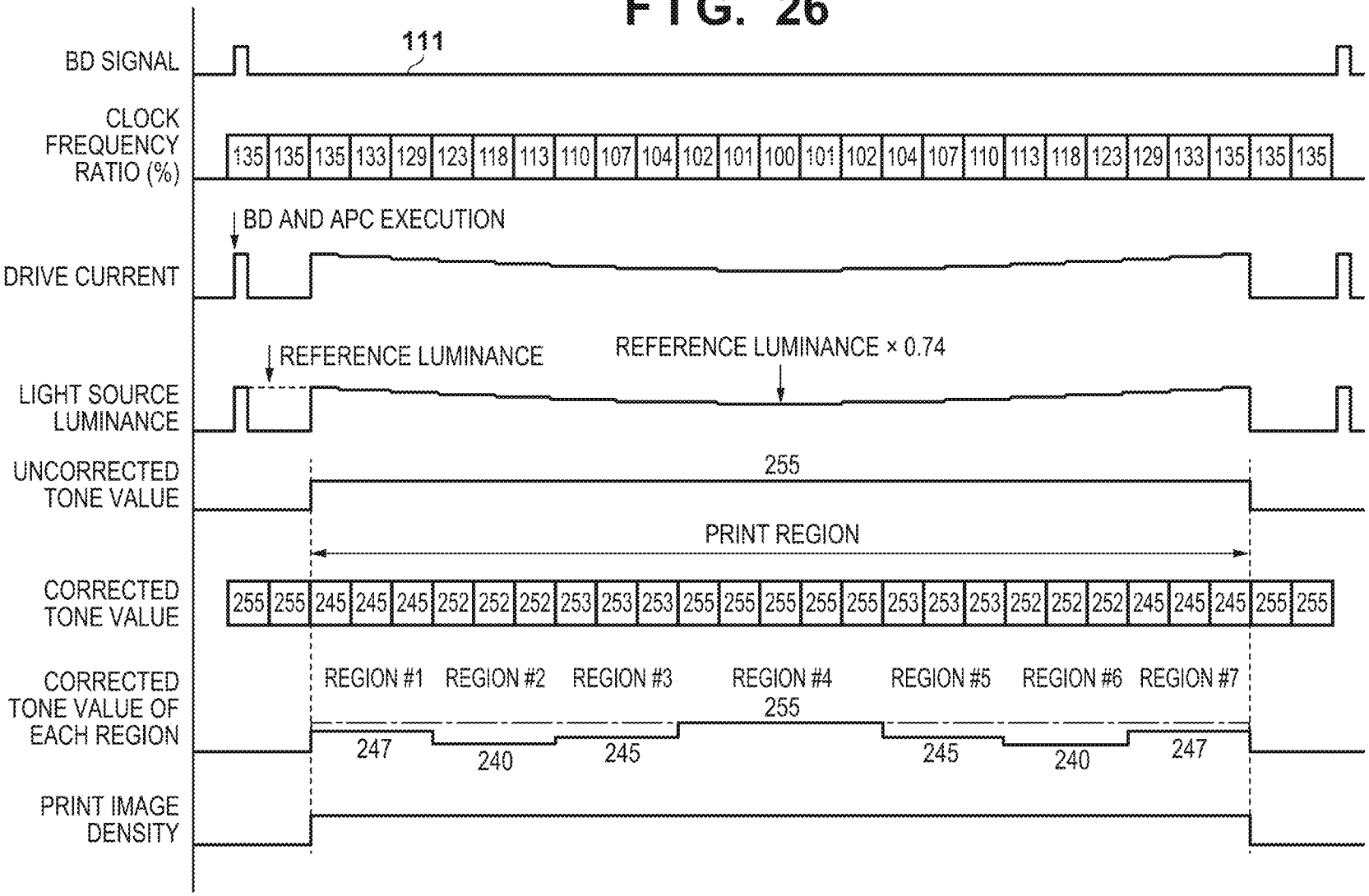
FIG. 26 is a diagram for describing partial magnification correction, luminance correction, and density correction according to one embodiment.

FIG. 26 is a diagram for describing the density correction according to the present embodiment, and the uncorrected tone values are 255, similarly to the embodiments described above. As shown in FIG. 26, in the present embodiment, the corrected tone values in the regions #1 and #7 are 247. Also, the corrected tone values in the regions #2 and #6 are 240. Furthermore, the corrected tone values in the regions #3 and #5 are 245, and the corrected tone value in the region #4 is 255.

Figure 21A:
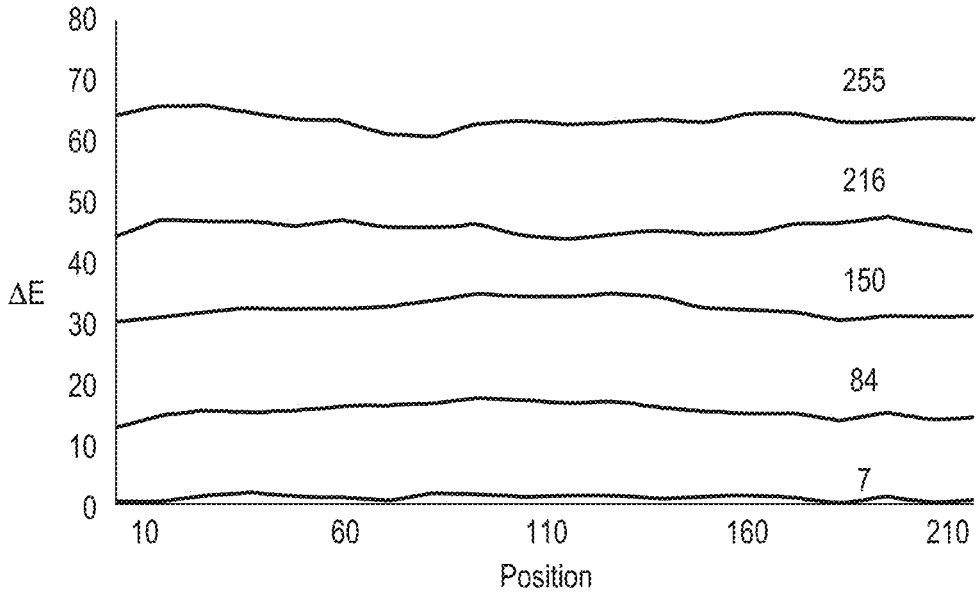
FIG. 21A is a diagram illustrating a density change of a printed image in the main scanning direction according to a fourth embodiment.
Figure 21B:
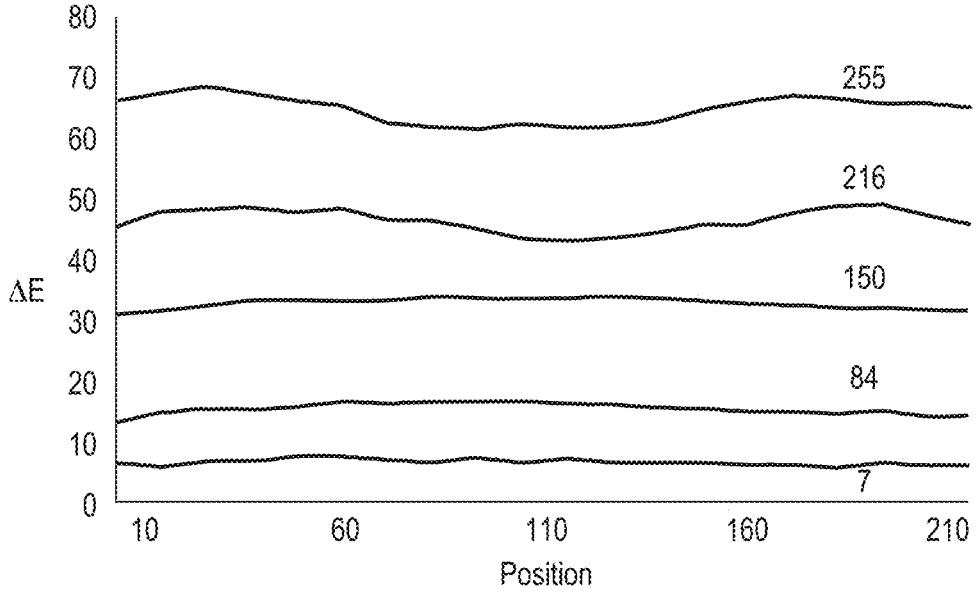
FIG. 21B is a diagram illustrating a density change of a printed image in the main scanning direction according to Comparative example 3.

FIG. 21B shows changes in density in the main scanning direction for some tones in a configuration of Comparative example 3 in which density correction processing is not performed, and printing is performed using the input tone values as is. As described above, a change in density occurs in which the change in density due to the characteristics of the optical scanning apparatus 400 and the exposure control characteristics when the optical scanning apparatus 400 is used and the change in density due to the characteristics of the developing unit are combined. On the other hand, FIG. 21A shows changes in density in the main scanning direction for some tones in the configuration according to the present embodiment. As a result of the density correction described above, the change in density can be suppressed in which the change in density due to the characteristics of the optical scanning apparatus 400 and the exposure control characteristics when the optical scanning apparatus 400 is used and the change in density due to the characteristics of the developing unit are combined.

Note that, in the present embodiment, the density correction processing unit 101z corrects the change in density in which the change in density in the main scanning direction described in the first embodiment and the change in density in the main scanning direction due to the configuration of the developing unit are combined. However, a configuration may also be adopted in which the density correction processing unit 101z corrects the change in density in which the change in density in the main scanning direction described in the second embodiment and the change in density in the main scanning direction due to the configuration of the developing unit are combined. Furthermore, if the developing unit 208 is a toner projection development type described in the third embodiment, for example, a configuration may be adopted in which the density correction processing unit 101z corrects the change in density in which the change in density caused by the change in distance between the developing sleeve 203 and the photosensitive member 4 and the change in density caused by another factor of the configuration of the developing unit 208 are combined. Note that the change in density caused by another factor of the configuration of the developing unit 208 is a change in density caused by the change in flowability of toner inside the storage container 206 in the main scanning direction, for example. Furthermore, in the present embodiment as well, the change in density in the main scanning direction can be suppressed by performing luminance correction instead of tone correction performed by the density correction processing unit 101z.

Fifth Embodiment

Next, a fifth embodiment will be described focusing on differences with the third embodiment. In the present embodiment, the density correction information to be used is switched according to the usage status of the developing unit 208. As shown in FIG. 19A, the developing unit 208 is configured to be rotatable about the coupling member 210, and the developing sleeve 203 is pressed toward the photosensitive member 4 by a biasing member that is not illustrated and the weight of the developing unit 208. Therefore, the weight changes depending on the amount of toner stored in the storage container 206 of the developing unit 208, and the amount of deformation of the developing sleeve 203 in which the central portion thereof deforms toward the photosensitive member 4 changes as well. Therefore, the developing characteristics in the main scanning direction also change according to the amount of toner stored in the storage container 206 (hereinafter, simply referred to as a remaining toner amount). For example, in the configuration shown in FIG. 19A, when the remaining toner amount decreases, the distance between the developing sleeve 203 and the photosensitive member 4 at the central portion in the main scanning direction decreases, and the image density at the central portion increases.

In the present embodiment, a plurality of pieces of density correction information are stored in the ROM 102, and the density correction information to be used is selected according to the remaining toner amount. Two pieces of density correction information, namely first density correction information to be used when the remaining toner amount is 25% or more and second density correction information to be used when the remaining toner amount is less than 25%, are used as an example. When the remaining toner amount is 25% or more, the first density correction information that has been described using FIG. 25 is used. Also, when the remaining toner amount falls below 25%, the second density correction information is used. For example, when the uncorrected tone value is 255, the corrected tone value based on the second density correction information is 255 in the regions #1 and #7, 240 in the regions #2 and #6, 235 in the regions #3 and #5, and 225 in the region #4. In this way, the reduction amounts in tone value are larger than those based on the first density correction information except for the regions #1 and #7.

Figure 22A:
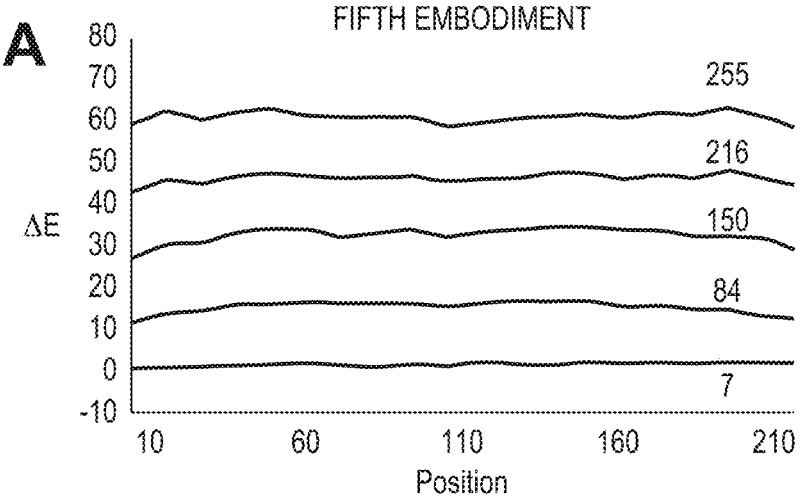
FIG. 22A is a diagram illustrating a density change of a printed image in the main scanning direction according to a fifth embodiment.

FIG. 22A shows changes in density in the main scanning direction for some tones in a configuration of the present embodiment, when the remaining toner amount is 20%. As the toner is consumed, the distance between the developing sleeve 203 and the photosensitive member 4 decreases, and therefore the second density correction information is used. As a result, the difference in developability due to the partial change in distance between the developing sleeve 203 and the photosensitive member 4 is suppressed, and the change in density in the main scanning direction can be reduced.

Figure 22B:
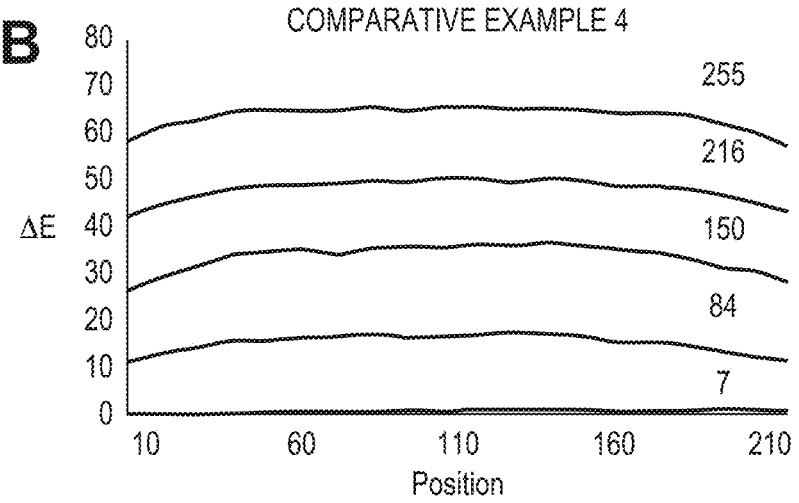
FIG. 22B is a diagram illustrating a density change of a printed image in the main scanning direction according to Comparative example 4.
Figure 22C:
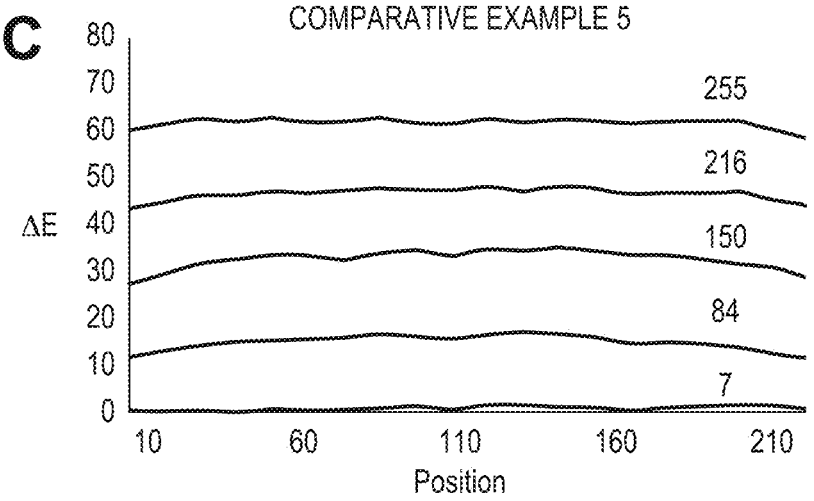
FIG. 22C is a diagram illustrating a density change of a printed image in the main scanning direction according to Comparative example 5.

FIG. 22B shows changes in density in the main scanning direction for some tones in a configuration of Comparative example 4 in the case where density correction processing is not performed. FIG. 22C shows changes in density in the main scanning direction for some tones in a configuration of Comparative example 5 in the case where the same density correction information is used, without being switched, even if the remaining toner amount decreases, as in the third embodiment. The density at the central portion in the main scanning direction is higher than those at the end portions, in both Comparative examples 4 and 5. This is caused by the change in developing characteristics due to the deformation of the developing sleeve 203, as described above. Note that, in the present embodiment, switching is performed between two pieces of density correction information using one remaining toner amount threshold value (25%), but a configuration may be adopted in which switching is performed between a plurality of (three or more) pieces of density correction information using a plurality of remaining toner amount threshold values.

Sixth Embodiment

Next, a sixth embodiment will be described focusing on differences with the fifth embodiment. In the present embodiment, a developing unit is configured to use a contact development method using non-magnetic one-component toner as the developer. In the contact development method as well, the density changes in the main scanning direction. This is because toner particles at end portions are likely to be more charged due to friction than toner particles in a central portion. As a result, the image density is likely to decrease in the end portions relative to that in the central portion in the main scanning direction.

Furthermore, in the contact development method, the difference in density in the main scanning direction changes in accordance with usage state of the developing unit. In the contact development method, the developing sleeve 203 is brought into contact with the photosensitive member 4, and the rotating speed of the developing sleeve 203 differs from that of the photosensitive member 4. Therefore, the surface layer of the photosensitive member 4 is scraped away when used. Here, the photosensitive member 4 is made of a thin film aluminum material as the base material, and slightly flexes, and therefore the photosensitive member 4 is scraped more at end portions in the main scanning direction than at a central portion. Electrostatic capacitance increases in a portion of the photosensitive member 4 that is more scraped away, and the absolute value of the charged potential when charged by the charging unit increases (in the example, the charged potential takes a negative value). When the charged potential increases, the absolute value of the exposure potential also increases (in the present embodiment, the exposure potential takes a negative value). As a result, the contrast against the developing potential decreases at the scraped portion, and the image density decreases.

That is, in the developing unit using the contact development method, the image density at end portions in the main scanning direction decreases relative to that at a central portion, as the rotation time of the developing sleeve 203 and the photosensitive member 4 increases. Therefore, in the present embodiment, the density correction conditions are set such that the image density is to be uniform in the main scanning direction while considering a change in developing characteristics in accordance with the rotation time of the developing sleeve 203. Specifically, a first density correction condition that is used until the accumulated rotation time of the developing sleeve 203 reaches a predetermined time and a second density correction condition that is used when the accumulated rotation time of the developing sleeve 203 exceeds the predetermined time are determined in advance. The second density correction condition is set such that the corrected tone value at the central portion is smaller than that in the first density correction condition. Note that a configuration may be adopted in which a plurality of threshold values of the accumulated rotation time are provided, and one density correction condition selected from the three or more density correction conditions in accordance with the accumulated rotation time is used.

Seventh Embodiment

Next, a seventh embodiment will be described focusing on differences with the sixth embodiment. As described in the sixth embodiment, in a developing unit using the contact development method, the amount of charges generated through friction of toner particles is larger at end portions than at a central portion, and therefore, the image density is more likely to decrease at the end portions than at the central portion. This is because toner particles near end portions of the developing sleeve 203 flow slower than those on a central side, in the storage container 206. Here, the flowability of toner particles has temperature characteristics. Specifically, the flowability of toner particles decreases when the ambient environment in which the image forming apparatus is used is a high temperature environment, or when the temperature inside the machine increases when the image forming apparatus is continuously used. As a result, the image density at the end portions decreases relative to that at the central portion.

Therefore, in the present embodiment, the density correction condition is set such that the image density of a printed item is to be uniform in the main scanning direction while considering the usage temperature of toner. For example, if the detected temperature of a temperature and humidity sensor exceeds 27 degrees, the density correction condition is switched so as to decrease the image density at the central portion. Also, a configuration may be adopted, by combining the sixth embodiment and the seventh embodiment, in which the density correction condition to be used is selected from a plurality of density correction conditions based on the temperature and the accumulated rotation time.

Other Embodiments

Various embodiments of the present invention have been described using a monochrome image forming apparatus. However, the present invention can be applied to intermediate transfer type and tandem transfer type color image forming apparatuses.

Figure 23A:
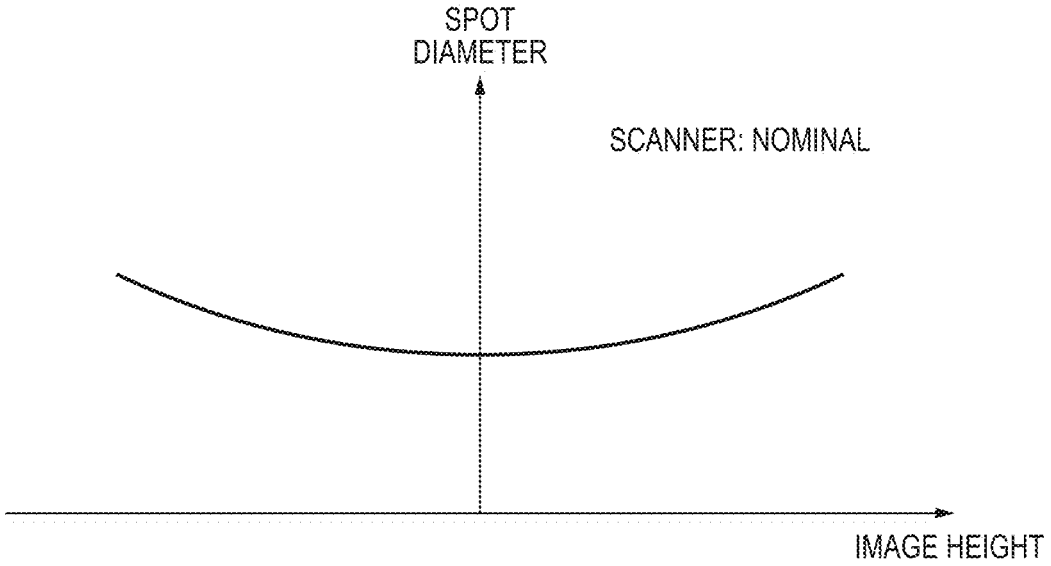
FIGS. 23A and 23B are diagrams illustrating a relationship between an image height and a spot diameter.
Figure 23B:
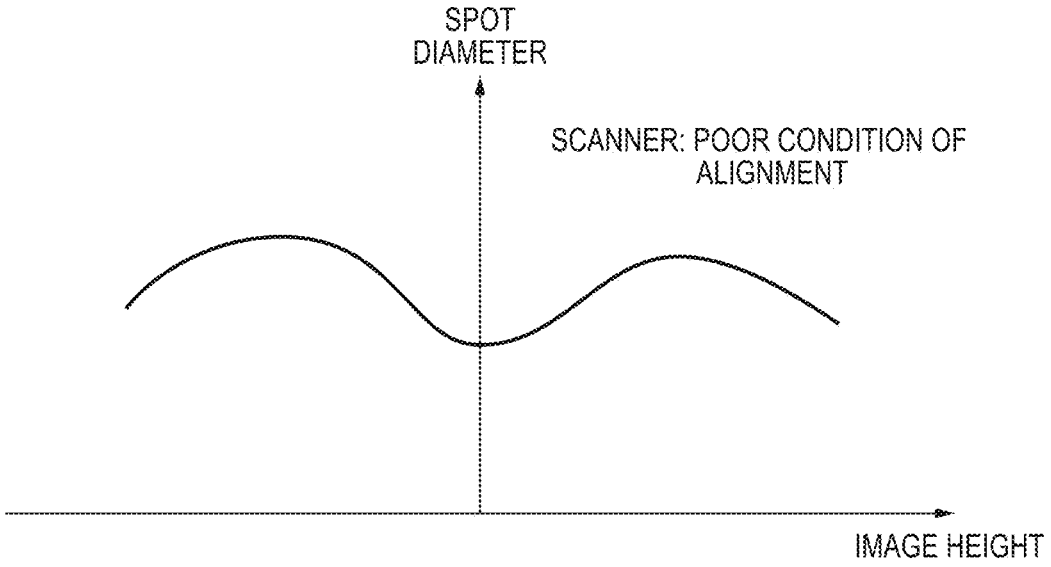

Also, in the first embodiment, the potential difference of the photosensitive member 4 due to the difference in the spot diameter is suppressed by performing both luminance correction and density correction. Here, the change in the spot diameter depends on the configuration of the optical scanning apparatus 400, and the spot diameter does not necessarily take a maximum value at end portions in the main scanning direction. FIGS. 23A and 23B show image height dependencies of the spot diameter. Typically, the image height dependency of the spot diameter shows a curve whose value takes a maximum value at end portions in the main scanning direction, as shown in FIG. 23A. However, depending on the alignment of members that constitute the optical scanning apparatus 400, there may be a case where the spot diameter once increases from a central portion toward an end portion in the main scanning direction, and thereafter decreases, as shown in FIG. 23B. In this case, correction may be performed such that the light amount is reduced at an image height at which the spot diameter is large.

Also, the third embodiment has been described using the developing unit 208 that uses a toner projection development method. However, similar effects are obtained in a similar development method such as contact development, and the present embodiment can be applied to a developing unit that uses such a development method. Also, in the embodiments described above, the scan line is divided into seven regions along the main scanning direction, and the density correction information shows correction amounts of tone values in the respective regions. However, the number of divided regions is not limited to seven, and may be any number of two or more. Note that any combination of the embodiments described above is possible.

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-006690, filed on Jan. 18, 2018, which is hereby incorporated by reference herein in its entirety.

What is claimed is:

1. An image forming apparatus comprising:

a photosensitive member;

a scan unit configured to form a latent image on the photosensitive member by scanning the photosensitive member with laser light at a non-constant scanning speed over a plurality of sections in a main-scanning direction according to image data indicating image density;

a developing unit configured to form an image on the photosensitive member by attaching toner to the latent image formed on the photosensitive member;

a luminance correction unit configured to correct an emission luminance of the laser light depending on a section of the plurality of sections in the main-scanning direction; and a density correction unit configured to correct the image data to change image density depending on a section of the plurality of sections in the main-scanning direction, wherein the luminance correction unit is further configured to correct the emission luminance such that a first emission luminance for a first section, of the plurality of sections, scanned at a first scanning speed is lower than a second emission luminance for a second section, of the plurality of sections, scanned at a second scanning speed faster than the first scanning speed, and the density correction unit is further configured to correct the image data such that a first image density of the image data corresponding to the first section is higher than a second image density of the image data corresponding to the second section.

2. The image forming apparatus according to claim 1, wherein the density correction unit is further configured to correct the image data when forming the image with an image density higher than a predetermined image density, and not to correct the image data when forming the image with an image density lower than the predetermined image density.

3. The image forming apparatus according to claim 1, wherein the density correction unit is further configured to correct the image data such that an image density change of the image in the main-scanning direction due to a configuration of the developing unit is reduced.

4. The image forming apparatus according to claim 3, wherein the developing unit is configured such that a developing sleeve for attaching the toner to the latent image on the photosensitive member does not come into contact with the photosensitive member, and the density correction unit is further configured to correct a tone value of the image data such that an image density change in the main-scanning direction caused by nonuniformity in a distance between the developing sleeve and the photosensitive member in the main-scanning direction is reduced.

5. The image forming apparatus according to claim 4, wherein the density correction unit includes a plurality of pieces of correction information that indicate a relationship between each of the plurality of sections and a correction amount of the tone value, and the density correction unit is further configured to correct the tone value indicated by the image data based on correction information selected from the plurality of pieces of correction information according to an amount of toner included in the developing unit.

6. The image forming apparatus according to claim 3, wherein the developing unit includes a storage container that stores the toner, and the density correction unit is further configured to correct a tone value of the image data such that an image density change in the main-scanning direction due to nonuniformity in flowability of the toner stored in the storage container in the main-scanning direction is reduced.

7. The image forming apparatus according to claim 3, wherein the density correction unit includes a plurality of pieces of correction information that indicate a relationship between each of the plurality of sections and a correction amount of a tone value, and the density correction unit is further configured to correct the tone value indicated by the image data based on correction information selected from the plurality of pieces of correction information according to a usage state of the developing unit.

8. The image forming apparatus according to claim 3, wherein the developing unit is configured such that a developing sleeve for attaching the toner to the latent image on the photosensitive member comes into contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to an accumulated rotation time of the developing sleeve.

9. The image forming apparatus according to claim 8, further comprising a detection unit configured to detect a temperature of the image forming apparatus, wherein the density correction unit is further configured to use the temperature detected by the detection unit when the correction information is selected from the plurality of pieces of correction information.

10. The image forming apparatus according to claim 8, wherein the developing unit includes a storage container for storing the toner, and the plurality of pieces of correction information each indicate the correction amount of the tone value of the image data in order to reduce an image density change in the main-scanning direction due to nonuniformity in flowability of the toner stored in the storage container in the main-scanning direction.

11. The image forming apparatus according to claim 3, further comprising a detection unit configured to detect a temperature of the image forming apparatus, wherein the developing unit is configured such that a developing sleeve for attaching the toner to the latent image on the photosensitive member comes in contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to the temperature detected by the detection unit.

12. The image forming apparatus according to claim 1, further comprising a half-tone processing unit configured to perform half-tone processing on the image data, wherein the density correction unit is further configured to correct a tone value indicated by the image data, and the half-tone processing unit is further configured to perform the half-tone processing on the image data corrected by the density correction unit.

13. The image forming apparatus according to claim 12, wherein the density correction unit is further configured to correct the tone value of the image data such that an image density change in the main-scanning direction caused by a change in a spot diameter of the laser light on the photosensitive member is reduced.

14. The image forming apparatus according to claim 12, wherein the density correction unit is further configured to correct the tone value of the image data such that both an image density change in the main-scanning direction caused by a change in an exposure amount of the photosensitive member due to a change in the scanning speed, and an image density change in the main-scanning direction caused by a change in a spot diameter of the laser light on the photosensitive member are reduced.

15. The image forming apparatus according to claim 12, wherein the density correction unit is further configured to correct the tone value indicated by the image data based on correction information indicating a relationship between each of the plurality of sections and a correction amount of the tone value.

16. An image forming apparatus comprising:

a photosensitive member;

a scan unit configured to form a latent image on the photosensitive member by scanning the photosensitive member with laser light at a non-constant scanning speed over a plurality of sections in a main-scanning direction according to image data indicating image density;

a developing unit configured to form an image on the photosensitive member by attaching toner to the latent image formed on the photosensitive member; and a density correction unit configured to correct the image data to change the image density depending on a section of the plurality of sections in the main-scanning direction, wherein the density correction unit is further configured to perform a first correction according to a scanning speed and a second correction according to the image density, by the first correction, a first image density of a first section, of the plurality of sections, scanned at a first scanning speed becomes lower than a second image density of a second section, of the plurality of sections, scanned at a second scanning speed faster than the first scanning speed, an image density difference between the first image density and the second image density becoming a first image density difference, and by the second correction, a density difference between the first image density and the second image density becomes a second image density difference less than the first image density difference.

17. The image forming apparatus according to claim 16, wherein the density correction unit is further configured to perform the first correction when forming the image with an image density lower than a predetermined image density, and to perform both the first correction and the second correction when forming the image with an image density higher than the predetermined image density.

18. The image forming apparatus according to claim 16, wherein the density correction unit is further configured to correct the image data such that an image density change of the image in the main-scanning direction due to a configuration of the developing unit is reduced.

19. The image forming apparatus according to claim 18, wherein the developing unit is configured such that a developing sleeve for attaching the toner to the latent image on the photosensitive member does not come into contact with the photosensitive member, and the density correction unit is further configured to correct a tone value of the image data such that an image density change in the main-scanning direction caused by nonuniformity in a distance between the developing sleeve and the photosensitive member in the main-scanning direction is reduced.

20. The image forming apparatus according to claim 18, wherein the developing unit includes a storage container that stores the toner, and the density correction unit is further configured to correct a tone value of the image data such that an image density change in the main-scanning direction due to nonuniformity in flowability of the toner stored in the storage container in the main-scanning direction is reduced.

21. The image forming apparatus according to claim 18, wherein the developing unit is configured such that a developing sleeve for attaching the toner to the latent image on the photosensitive member comes into contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to an accumulated rotation time of the developing sleeve.

22. The image forming apparatus according to claim 18, further comprising a detection unit configured to detect a temperature of the image forming apparatus, wherein the developing unit is configured such that a developing sleeve for attaching the toner to the latent image on the photosensitive member comes in contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to the temperature detected by the detection unit.

23. The image forming apparatus according to claim 16, further comprising a half-tone processing unit configured to perform half-tone processing on the image data, wherein the density correction unit is further configured to correct a tone value indicated by the image data, and the half-tone processing unit is further configured to perform the half-tone processing on the image data corrected by the density correction unit.

24. The image forming apparatus according to claim 23, wherein the density correction unit is further configured to correct the tone value of the image data such that an image density change in the main-scanning direction caused by a change in a spot diameter of the laser light on the photosensitive member is reduced.

25. An image forming apparatus comprising:

a photosensitive member;

a scan unit configured to form a latent image on the photosensitive member by scanning the photosensitive member with laser light at a non-constant scanning speed over a plurality of sections in a main-scanning direction according to image data indicating image density;

a developing unit configured to form an image on the photosensitive member by attaching toner to the latent image formed on the photosensitive member; and a density correction unit configured to correct the image data to change the image density depending on a section of the plurality of sections in the main-scanning direction, wherein the density correction unit is further configured to perform a first correction when forming the image with an image density lower than a predetermined image density, and to perform a second correction when forming the image with an image density higher than the predetermined image density, by the first correction, a ratio of a second density to a first density lower than the second density becomes a first ratio, the first density being a density of a first section, of the plurality of sections, scanned at a first scanning speed, and the second density being a density of a second section, of the plurality of sections, scanned at a second scanning speed faster than the first scanning speed, and by the second correction, a ratio of the second density to the first density becomes a second ratio lower than the first ratio.

26. The image forming apparatus according to claim 25, wherein the density correction unit is further configured to correct the image data such that an image density change of the image in the main-scanning direction due to a configuration of the developing unit is reduced.

27. The image forming apparatus according to claim 26, wherein the developing unit is configured such that a developing sleeve for attaching the toner to the latent image on the photosensitive member does not come into contact with the photosensitive member, and the density correction unit is further configured to correct a tone value of the image data such that an image density change in the main-scanning direction caused by nonuniformity in a distance between the developing sleeve and the photosensitive member in the main-scanning direction is reduced.

28. The image forming apparatus according to claim 26, wherein the developing unit includes a storage container that stores the toner, and the density correction unit is further configured to correct a tone value of the image data such that an image density change in the main-scanning direction due to nonuniformity in flowability of the toner stored in the storage container in the main-scanning direction is reduced.

29. The image forming apparatus according to claim 26, wherein the developing unit is configured such that a developing sleeve for attaching the toner to the latent image on the photosensitive member comes into contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to an accumulated rotation time of the developing sleeve.

30. The image forming apparatus according to claim 26, further comprising a detection unit configured to detect a temperature of the image forming apparatus, wherein the developing unit is configured such that a developing sleeve for attaching the toner to the latent image on the photosensitive member comes in contact with the photosensitive member, and the density correction unit includes a plurality of pieces of correction information that indicate a relationship between each of the plurality of sections and a correction amount of a tone value, and is further configured to correct the tone value indicated by the image data based on correction information selected from the plurality of pieces of correction information according to the temperature detected by the detection unit.

31. The image forming apparatus according to claim 25, further comprising a half-tone processing unit configured to perform half-tone processing on the image data, wherein the density correction unit is further configured to correct a tone value indicated by the image data, and the half-tone processing unit is further configured to perform the half-tone processing on the image data corrected by the density correction unit.

32. The image forming apparatus according to claim 31, wherein the density correction unit is further configured to correct the tone value of the image data such that an image density change in the main-scanning direction caused by a change in a spot diameter of the laser light on the photosensitive member is reduced.

* * * * *